US010486426B2

(12) United States Patent
Nagashima et al.

(10) Patent No.: US 10,486,426 B2
(45) Date of Patent: Nov. 26, 2019

(54) CARTRIDGE AND LIQUID SUPPLY UNIT

(71) Applicant: SEIKO EPSON CORPORATION, Tokyo (JP)

(72) Inventors: Takumi Nagashima, Matsumoto (JP); Hiroyoshi Ozeki, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/924,072

(22) Filed: Mar. 16, 2018

(65) Prior Publication Data

US 2018/0272726 A1 Sep. 27, 2018

(30) Foreign Application Priority Data

Mar. 24, 2017 (JP) ..... 2017-058949

(51) Int. Cl.

*B41J 2/175* (2006.01)
*B41J 29/02* (2006.01)
*B41J 29/13* (2006.01)

(52) U.S. Cl.

CPC ..... *B41J 2/17513* (2013.01); *B41J 2/175* (2013.01); *B41J 2/1752* (2013.01); *B41J 2/1753* (2013.01); *B41J 2/17509* (2013.01); *B41J 2/17523* (2013.01); *B41J 2/17526* (2013.01); *B41J 2/17553* (2013.01); *B41J 29/02* (2013.01); *B41J 29/13* (2013.01); *B41J 2002/17516* (2013.01)

(58) Field of Classification Search

CPC .. B41J 2/1752; B41J 2/17546; B41J 2/17553; B41J 2/17526; B41J 2/1753; B41J 2/17513; B41J 2002/14491; B41J 2/17523; B41J 2/17503; B41J 2/17509; B41J 29/13; B41J 2002/17516; B41J 29/02; B41J 2/175

USPC ..... 347/6, 7, 50, 84–86

See application file for complete search history.

(56) References Cited

U.S. PATENT DOCUMENTS

| | | | |
|---|---|---|---|
| 5,008,688 | A | 4/1991 | Ebinuma et al. |
| 7,293,864 | B2 | 11/2007 | Kimura et al. |
| 8,646,889 | B2 | 2/2014 | Aoki et al. |
| 9,139,013 | B2 | 9/2015 | Nagashima et al. |

(Continued)

FOREIGN PATENT DOCUMENTS

| | | | |
|---|---|---|---|
| JP | 06-064185 | A | 3/1994 |
| JP | 2005-096446 | A | 4/2005 |

(Continued)

*Primary Examiner* — Jannelle M Lebron

(74) *Attorney, Agent, or Firm* — Foley & Lardner LLP

(57) ABSTRACT

Provided is technology for improving a mechanism for attaching a cartridge to a printer. A cartridge includes a main body that includes a front face, a rear face that opposes the front face, a lower face, an upper face that opposes the lower face, and two side faces, a liquid container that is provided inside the main body, and contains liquid, a liquid supply port that is provided in the front face, and is connected to a liquid introduction portion of a printer so as to supply the liquid contained in the liquid container, a cartridge-side electrical connector that is provided in the front face, and is to be connected to a device-side electrical connector of the printer while receiving a biasing force from a terminal portion, and a lock mechanism that is provided in the rear face, and restricts movement of the cartridge in an attached state.

8 Claims, 15 Drawing Sheets

(56) References Cited

U.S. PATENT DOCUMENTS

| | | | | |
|---|---|---|---|---|
| 2016/0200114 | A1* | 7/2016 | Nanjo | B41J 2/17526<br>347/86 |
| 2016/0279955 | A1* | 9/2016 | Wang | B41J 2/17523 |

FOREIGN PATENT DOCUMENTS

| | | | |
|---|---|---|---|
| JP | 2012-140011 | A | 7/2012 |
| JP | 2014-240182 | A | 12/2014 |

* cited by examiner

CARTRIDGE AND LIQUID SUPPLY UNIT

CROSS REFERENCE TO RELATED APPLICATIONS

This application claims priority to Japanese Application No. 2017-058949 filed on Mar. 24, 2017. The entire disclosure of this Japanese application is expressly incorporated by reference herein.

BACKGROUND

1. Technical Field

The present invention relates to cartridges and liquid supply units.

2. Related Art

Some inkjet printers (hereinafter also simply referred to as "printer") receive a supply of ink, which is a liquid, from an attached cartridge. In such printers, when a cartridge is attached, an ink supply path and an electrical communication path with the cartridge are established (JP-A-6-64185, JP-A-2005-96446, JP-A-2014-240182, and the like, for example).

A printer is normally provided with a fixing structure for fixing a cartridge in order to maintain the connection state between the printer and the cartridge when the cartridge is attached. For example, in JP-A-6-64185, an ink tank corresponding to the cartridge is locked by a ratchet member in a state in which the ink tank is biased in a direction of being pushed out from an ink tank storage portion by a biasing member, and as a result, the ink tank is fixed to the ink tank storage portion. In JP-A-2005-96446 and JP-A-2014-240182, a device-side engagement structure that pivots under a spring force engages with a groove provided in a bottom face of a cartridge in a state in which the cartridge is biased in a direction of being pushed out from a cartridge attachment portion, and as a result, the cartridge is fixed to the cartridge attachment portion.

In order to keep a favorable connection state of the ink supply path and the electrical connection state between a cartridge and a printer, more reliable fixing of the cartridge to the printer is desirable. If the structure for fixing the cartridge is provided at a position that cannot be viewed by a user, as in JP-A-6-64185, JP-A-2005-96446, and JP-A-2014-240182, it is possible that the user cannot easily grasp whether or not the cartridge is properly attached and fixed. Also, if a cartridge is firmly fixed due to the cartridge having been inserted into the printer in an inclined state or the like, it is possible that the fixing structure cannot be easily accessed by a user and the maintenance thereof is difficult. Such problems become more apparent the more the fixing structure of the cartridge becomes complex. In addition, a configuration of a cartridge that enables operations to attach and detach the cartridge to and from the printer to be easily performed is required.

As described above, the mechanism of attaching a cartridge to a printer still needs to be improved. This kind of problem occurs not only in an inkjet printer, but also in various types of printers to which a cartridge is attached. Also, the problem occurs not only in this kind of printer, but also in a liquid supply unit to which a cartridge is attached and that supplies liquid to a printer.

SUMMARY

An advantage of some aspects of the invention is to solve at least some of the above-described problems, and can be realized in the following aspects.

[1] A cartridge is provided according to a first aspect of the invention. When a Z direction is defined as a direction parallel to a gravity direction, a direction the same as the gravity direction along the Z direction is defined as a +Z direction, a direction opposite to the gravity direction along the Z direction is defined as a −Z direction, a Y direction is defined as a direction orthogonal to the Z direction, one direction along the Y direction is defined as a +Y direction, the other direction along the Y direction is defined as a −Y direction, an X direction is defined as a direction orthogonal to the Z direction and the Y direction, one direction along the X direction is defined as a +X direction, and the other direction along the X direction is defined as a −X direction, the cartridge according to this aspect is inserted, in the +Y direction, to a printer that includes a liquid introduction portion extending in the Y direction and a device-side electrical connector including a terminal portion that is biased in the −Y direction, and is connected to the liquid introduction portion and the device-side electrical connector from the −Y direction side. The cartridge includes: a main body that includes, in an attached state in which the cartridge is attached to the printer, a front face that faces in the +Y direction, a rear face that is on a side opposite to the front face in the Y direction, and faces in the −Y direction, a lower face that faces in the +Z direction, an upper face that is on a side opposite to the lower face in the Z direction, and faces in the −Z direction, and two side faces that are on opposite sides in the X direction; a liquid container that is provided inside the main body, and contains liquid; a liquid supply port that is provided in the front face, and is connected, in the attached state, to the liquid introduction portion so as to supply the liquid contained in the liquid container; a cartridge-side electrical connector that is provided in the front face, and is connected, in the attached state, to the device-side electrical connector while receiving a biasing force in the −Y direction from the terminal portion; and a lock mechanism that is provided in the rear face, and restricts movement of the cartridge in the attached state in the −Y direction relative to the printer.

According to the cartridge of this aspect, the cartridge-side electrical connector is biased toward the −Y direction side from the terminal portion, and is tightly connected to the device-side electrical connector, and as a result, a favorable electrical connection between the cartridge-side electrical connector and the device-side electrical connector can be established. Also, movement of the cartridge is restricted so as to resist the biasing force received from the device-side electrical connector by the lock mechanism, and as a result, the cartridge can be kept in a state of being tightly connected to the printer. In addition, since the lock mechanism is provided at the rear face of the cartridge that can be easily accessed by a user, the attachment and detachment of the cartridge relative to the printer is made easier.

[2] In the above aspect, the printer may include a device-side fixing structure that fixes a fixing target that is inserted to a cartridge storage portion for storing the cartridge, from the outside of the printer by applying a biasing force in the −Z direction, and a biasing member that applies a biasing force in the −Y direction to the fixing target, and the cartridge may be configured to be attached to the printer without the main body receiving a biasing force from either of the device-side fixing structure and the biasing member.

According to the cartridge of this aspect, receiving a redundant biasing force, as a fixing target, from the device-side fixing structure and the biasing member can be suppressed when being inserted to the cartridge storage portion, and as a result, a user can attach the cartridge to the printer with less force. Therefore, the operation to attach the cartridge is made easier.

[3] In the cartridge of the above aspect, the main body may be configured such that, in the attached state, the front face is located on the −Y direction side relative to the device-side fixing structure and the biasing member.

According to the cartridge of this aspect, the occurrence of cases where the device-side fixing structure and the biasing member are brought into contact with the main body of the cartridge can be suppressed. Accordingly, the occurrence of cases where the cartridge receives a biasing force from the device-side fixing structure and the biasing member when the cartridge is attached to the printer can further be suppressed.

[4] In the cartridge of the above aspect, the liquid supply port and the cartridge-side electrical connector may be provided so as to protrude from the front face in the +Y direction in the attached state.

According to the cartridge of this aspect, the liquid supply port and the cartridge-side electrical connector can be caused to respectively arrive at positions of the liquid introduction portion and the device-side electrical connector, which are connection targets, in advance to the main body. Therefore, it is possible to suppress the occurrence of cases where the liquid introduction portion and the device-side electrical connector are brought into contact with the main body of the cartridge by accident when the cartridge is attached, and as a result, the liquid introduction portion and the device-side electrical connector are degraded. In addition, in the case where the printer includes the device-side fixing structure and the biasing member described above, a cartridge that can be connected to the printer while avoiding contact with the device-side fixing structure and the biasing member can be realized with simpler configuration.

[5] In the cartridge of the above aspect, the cartridge-side electrical connector may be brought into contact with the terminal portion of the device-side electrical connector from the −Y direction side and the +Z direction side, and receive a biasing force in the +Z direction in addition to a biasing force in the −Y direction from the terminal portion, in the attached state.

According to the cartridge of this aspect, a more favorable state of connection between the cartridge-side electrical connector and the device-side electrical connector on the printer side can be established.

[6] In the cartridge of the above aspect, the rear face may be provided with a gripper to be held by a user.

According to the cartridge of this aspect, a user can easily handle the cartridge using the gripper, and as a result, the operation to attach/detach the cartridge to/from the printer is made easier.

[7] In the cartridge of the above aspect, the liquid container may be constituted by a flexible bag-like member that is accommodated in the main body.

According to the cartridge of this aspect, the leakage of liquid from the cartridge, the evaporation of liquid, and the like are suppressed, and as a result, the preservability of liquid in the cartridge can be improved.

[8] In the cartridge of the above aspect, the liquid container may be configured by an inner space of a case that constitutes the main body.

According to the cartridge of this aspect, the capacity of the cartridge for liquid can be improved.

[9] According to a second aspect of the invention, a liquid supply unit for supplying liquid to a printer is provided. A Z direction is defined as a direction parallel to a gravity direction, a direction the same as the gravity direction along the Z direction is defined as a +Z direction, a direction opposite to the gravity direction along the Z direction is defined as a −Z direction, a Y direction is defined as a direction orthogonal to the Z direction, one direction along the Y direction is defined as a +Y direction, the other direction along the Y direction is defined as a −Y direction, an X direction is defined as a direction orthogonal to the Z direction and the Y direction, one direction along the X direction is defined as a +X direction, and the other direction along the X direction is defined as a −X direction. The printer is provided with a cartridge storage portion inside the printer. The printer includes a liquid introduction portion extending in the Y direction, a device-side electrical connector including a terminal portion that is biased in the −Y direction, a device-side fixing structure that fixes a fixing target that is inserted to the cartridge storage portion, from the outside of the printer by applying a biasing force in the −Z direction, and a biasing member that applies a biasing force in the −Y direction to the fixing target. The liquid supply unit includes: a cartridge that is to be inserted to the cartridge storage portion in the +Y direction, and is to be connected to the liquid introduction portion and the device-side electrical connector from the −Y direction side; and a lock portion that restricts movement of the cartridge that is in an attached state in which the cartridge is attached to the printer, in the −Y direction relative to the printer. The cartridge includes: a main body that includes, in the attached state, a front face that faces in the +Y direction, a rear face that is on a side opposite to the front face in the Y direction, and faces in the −Y direction, a lower face that faces in the +Z direction, and an upper face that is on a side opposite to the lower face in the Z direction, and faces in the −Z direction, and two side faces that are on opposite sides in the X direction; a liquid container that is provided inside the main body, and contains liquid; a liquid supply port that is provided in the front face, and is connected, in the attached state, to the liquid introduction portion so as to supply the liquid contained in the liquid container; and a cartridge-side electrical connector that is provided in the front face, and is connected, in the attached state, to the device-side electrical connector while receiving a biasing force in the −Y direction from the terminal portion. The cartridge is configured to be attached to the printer without the main body receiving a biasing force from either of the device-side fixing structure and the biasing member. The lock portion is provided on the −Y direction side relative to the rear face of the cartridge in the attached state.

According to the liquid supply unit of this aspect, the cartridge-side electrical connector is biased in the −Y direction by the terminal portion, and is tightly connected to the device-side electrical connector, and as a result, a state in which the cartridge is favorably electrically connected to the printer is established. Also, the movement of the cartridge is restricted, by the lock portion, so as to resist the biasing force received from the device-side electrical connector by the lock portion, and as a result, the cartridge can be kept in a state of being tightly connected to the printer. In addition, since the lock portion is provided on the rear face side of the cartridge that can be easily accessed by a user, the attachment/detachment of the cartridge to/from the liquid supply unit is made easier. In this liquid supply unit, the occurrence of cases where, when the cartridge is inserted to the cartridge storage portion, the cartridge receives a redundant biasing force, as a fixing target, from the device-side fixing structure and the biasing member can be suppressed, and as a result, the user can attach the cartridge to the printer with less force. Therefore, an operation to attach the cartridge to the liquid supply unit is made easier.

Not all of the constituent elements included in the above-described aspects of the invention are essential, and in order to solve some or all of the above-described problems or achieve some or all of the advantageous effects described in this specification, some of the constituent elements can be modified, omitted, and replaced with other constituent elements as necessary, and the defining content can be partially omitted. Also, in order to solve some or all of the above-described problems or achieve some or all of the above-described advantageous effects, some or all of the technical features in any of the above-described aspects of the invention can be combined with some or all of the technical features included in another one of the above-described aspects of the invention so as to obtain an independent aspect of the invention.

The invention may be realized in various modes other than the cartridge or the liquid supply unit. For example, the invention may be realized as modes such as an attachment and detachment method and an attachment and detachment structure of a cartridge in a printer or a liquid supply unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

In a first embodiment, a configuration of a printer 10 to which a cartridge 100 (FIGS. 6 and 8) of the first embodiment is to be attached is described with reference to FIGS. 1 to 5. Also, the configuration of the cartridge 100 will be described with reference to FIGS. 6 to 8, and the attachment mechanism of the cartridge 100 to the printer 10 will be described with reference to FIGS. 9, 10A, and 10B.

A1. Configuration of Printer:

External Configuration of Printer

Figure 1:
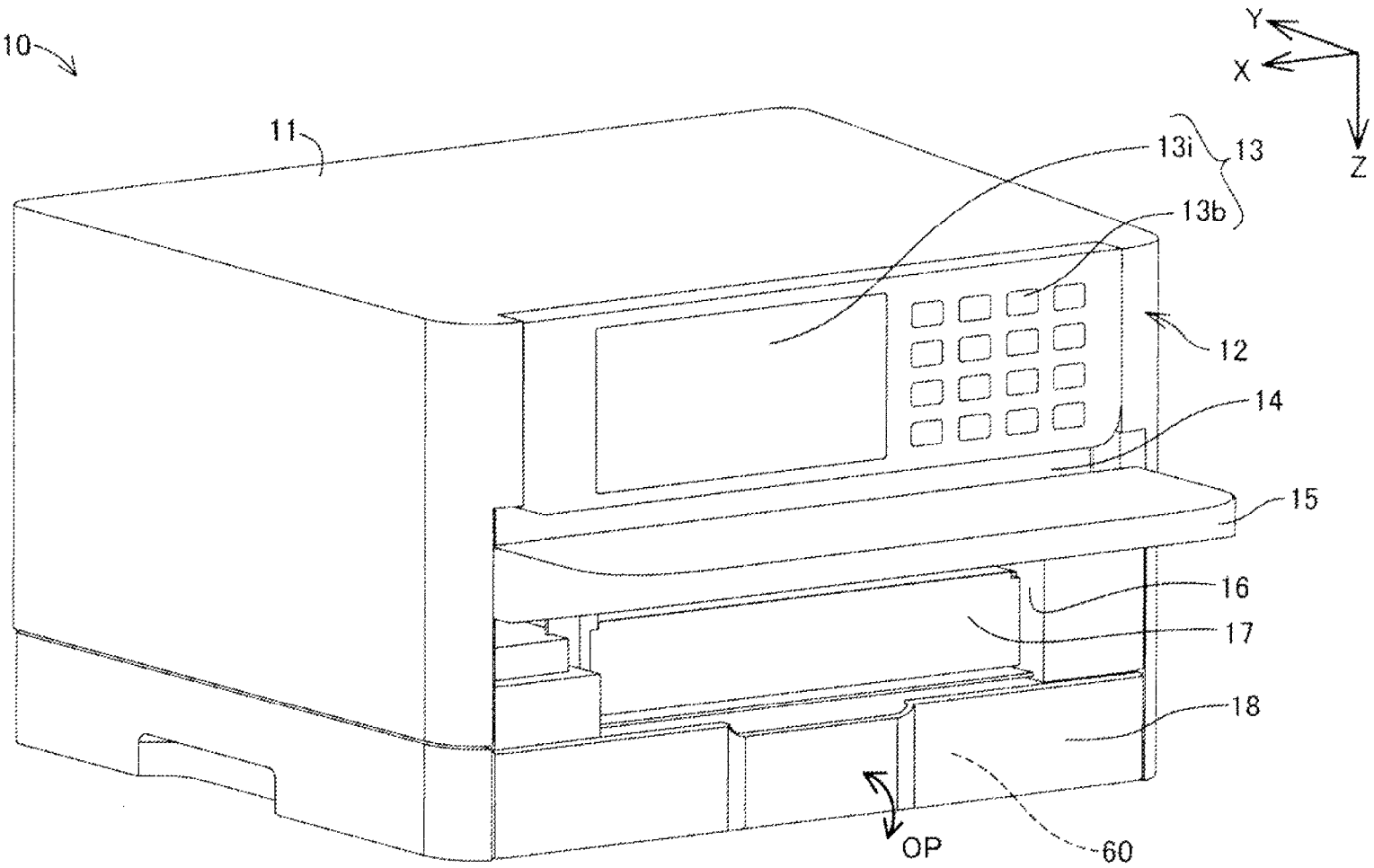
FIG. 1 is a schematic perspective view illustrating an external configuration of a printer.

FIG. 1 is a schematic perspective view illustrating an external configuration of the printer 10. Arrows X, Y, and Z that respectively indicate three directions that are orthogonal to each other are illustrated in FIG. 1. Note that the arrows X, Y, and Z are illustrated as appropriate in other drawings that are referred to in this specification in a manner so as to correspond to FIG. 1.

The directions indicated by the arrows X, Y, and Z correspond to an arrangement orientation of the printer 10 in a normal use state. The normal use state of the printer 10 refers to a state in which the printer 10 is placed on a horizontal surface for use. Hereinafter, the directions indicated by the arrows X, Y, and Z are respectively referred to as "X direction", "Y direction", and "Z direction". One direction in the X direction is referred to as "+X direction", and the other direction is referred to as "−X direction". Similarly, one direction in the Y direction is referred to as "+Y direction", and the other direction is referred to as "−Y direction", and one direction in the Z direction is referred to as "+Z direction", and the other direction is referred to as "−Z direction".

The X, Y, and Z directions will be described in order of the Z direction, the Y direction, and the X direction. The Z direction indicates a direction parallel to the gravity direction. The +Z direction is the gravity direction, and the −Z direction is a direction opposite to the gravity direction. The Z direction matches the up-down direction (height direction) of the printer 10. In the following description, "upward" and "downward" relative to the printer 10 means the up-down direction with the arrow Z direction being the reference unless otherwise specified. "Upward" means the −Z direction, and "downward" means the +Z direction. The Y direction indicates a direction parallel to a front-rear direction (depth direction) of the printer 10. The +Y direction is a direction from a front face side toward a rear face side of the printer 10, and the −Y direction is a direction from the rear face side toward the front face side. The X direction indicates a direction parallel to a left and right direction (width direction) of the printer 10. The +X direction matches the direction from a right side to a left side when directly facing the front face of the printer 10, and the −X direction matches the direction from the left side toward the right side. Note that, in this specification, the X, Y, and Z directions in a description relating to the cartridge 100 are based on the orientation in an attached state in which the cartridge 100 is properly attached to the printer 10 in a normal use state.

In the present embodiment, the printer 10 is an inkjet printer, which is one mode of the liquid ejection device. The printer 10 discharges ink, which is a liquid, toward a medium, and records ink dots on the medium so as to form an image. The medium is printing paper, for example. The printer 10 includes a housing 11, which is a hollow box made of resin, that forms the exterior of the printer 10. The housing 11 substantially has a rectangular parallelepiped shape. The housing 11 includes a front face 12 that faces toward the −Y direction side and is assumed to face a user when the user operates the printer 10. The front face 12 is provided with an operation portion 13, a medium discharge port 14, a medium receiver 15, a medium storage port 16, a medium storage 17, and a cover member 18.

The operation portion 13 includes a display 13*i* that displays information for a user, and a plurality of operation buttons 13*b* for accepting operations made by the user. The medium discharge port 14 is an outlet of a medium that is fed out from the inside of the printer 10. The medium discharge port 14 is formed as a slot-shaped opening having a large width in the X direction, and opens in the −Y direction. The medium receiver 15 extends out in the −Y direction in the manner of a hood below the medium discharge port 14, and receives a medium that has been discharged from the medium discharge port 14.

The medium storage port 16 is an opening through which a user supplies a medium to the printer 10. In the present embodiment, the medium storage port 16 is open in the −Y direction below the medium receiver 15, and has a substantially rectangular opening shape with a large width in the X direction. The medium storage 17 is a tray-shaped member that stores a medium stock. The medium storage 17 is stored in the printer 10 in a state in which the front face thereof can be seen from the outside of the printer 10 via the medium storage port 16. The user stores a medium in the medium storage 17 that has been drawn out from the printer 10 in the −Y direction through the medium storage port 16, and then returns the medium storage 17 in the printer 10 from the medium storage port 16, and as a result, a medium can be supplied to the printer 10.

The cover member 18 is a plate-shaped member made of resin that constitutes a portion of the housing 11 of the printer 10. In the present embodiment, the cover member 18 substantially has a rectangular shape with a large width in the X direction, and is located below the medium storage port 16. The cover member 18 opens and closes relative to the housing 11 by pivoting about a pivoting shaft (illustration omitted) on a lower end side. The cover member 18 covers and protects the cartridge storage portion 60 in which the cartridge 100 is stored. In FIG. 1, because the cartridge storage portion 60 is covered by the cover member 18 and cannot be seen, a reference sign is added at the position of the cartridge storage portion 60 by a broken line. When the cartridge 100 (FIGS. 6 and 8) is to be stored in the cartridge storage portion 60, the cover member 18 is opened.

Inner Structure of Printer

Figure 2:
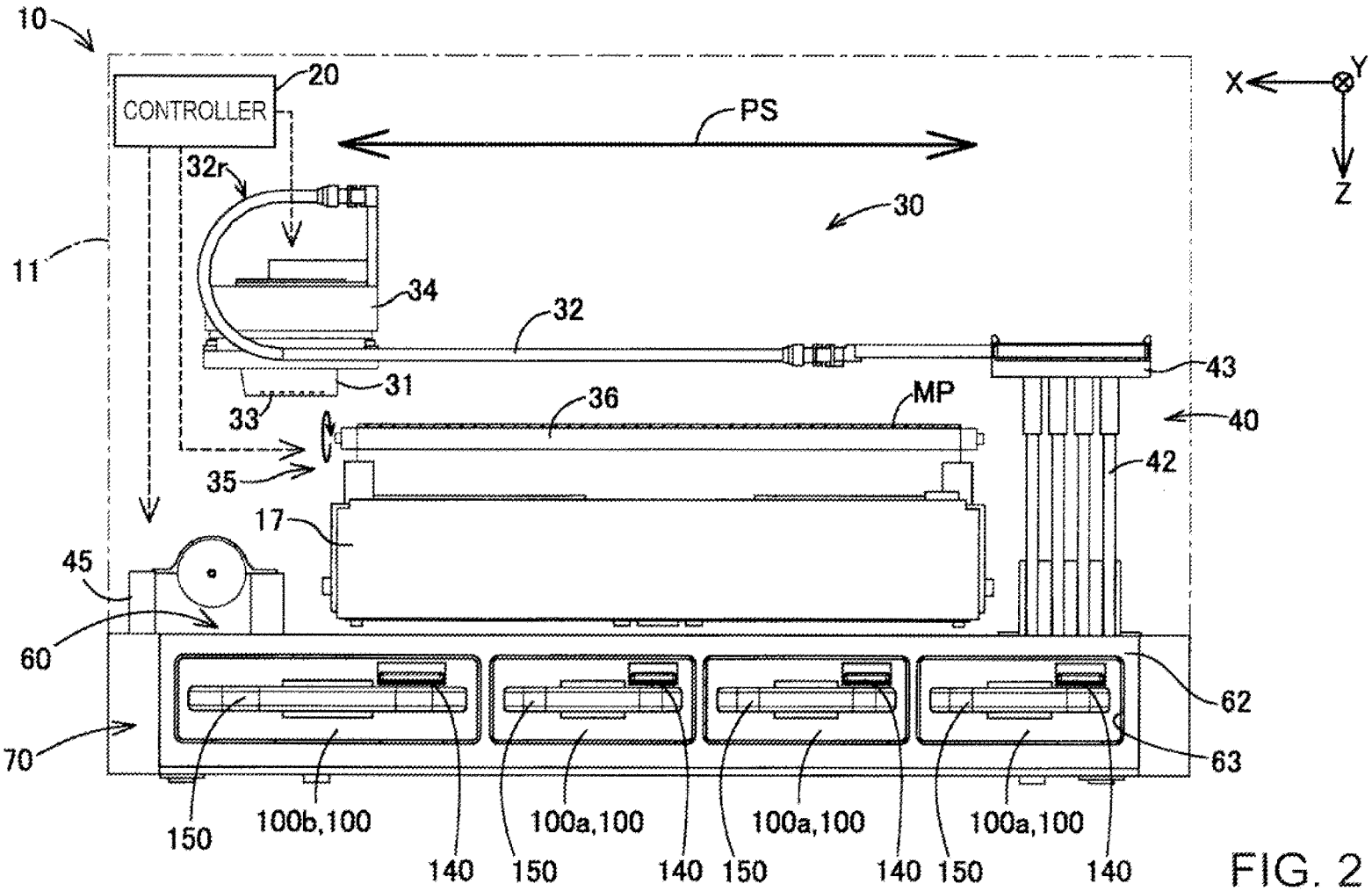
FIG. 2 is a schematic diagram illustrating an inner structure of the printer.
Figure 3:
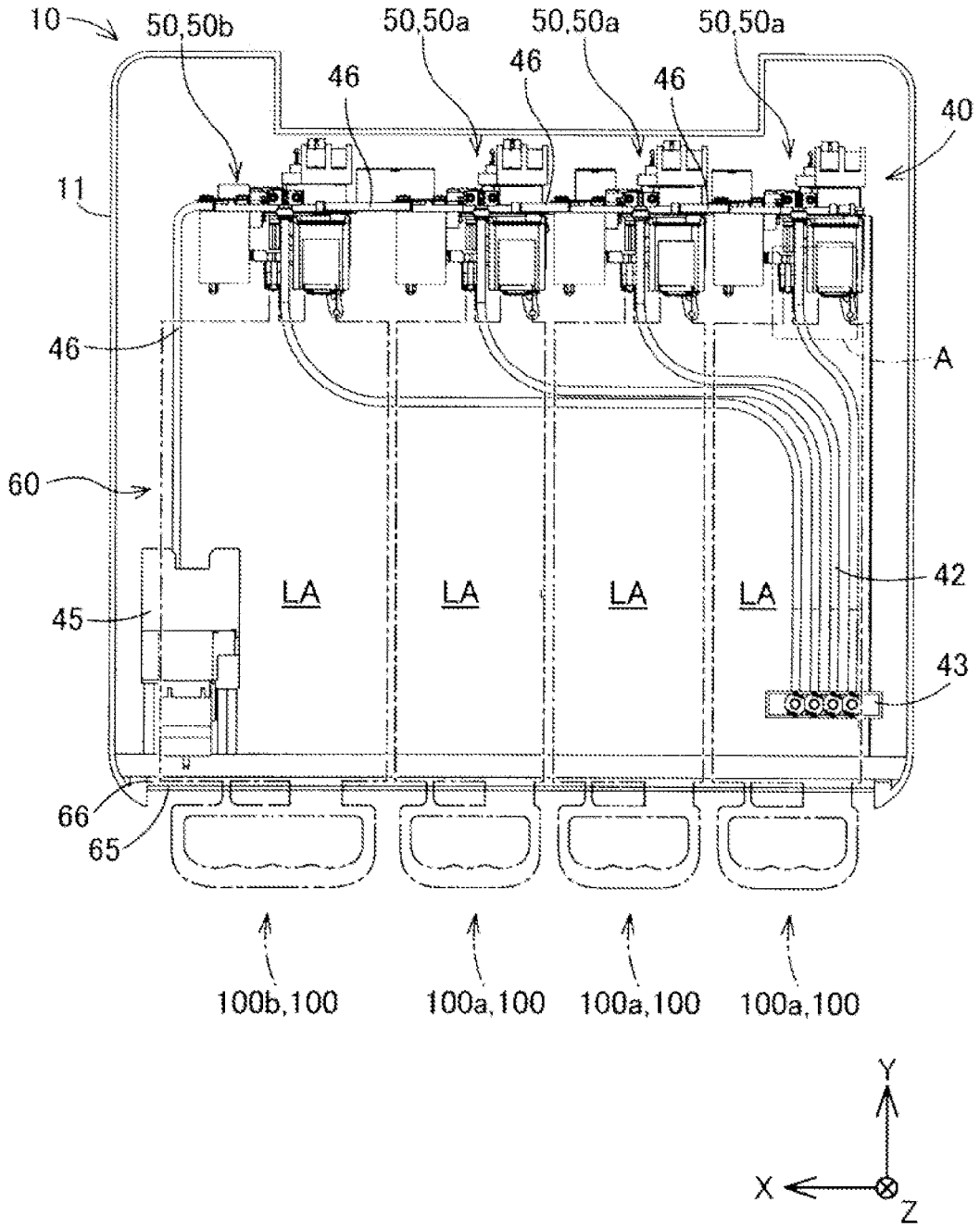
FIG. 3 is a schematic diagram illustrating a configuration of a cartridge storage portion.

An outline of the inner structure of the printer 10 will be described with reference to FIGS. 2 to 5 in order. FIG. 2 is a schematic diagram of the printer 10 when viewed in the +Y direction in a state in which the housing 11 and the cover member 18 are removed. In FIG. 2, a controller 20, an ejection execution portion 30, a medium conveyor 35, a liquid receiver 40, and the cartridge storage portion 60 are extracted from the main constituent elements of the printer 10 so as to be illustrated in the drawing. Also, in FIG. 2, a state in which a plurality of cartridges 100 are attached to the cartridge storage portion 60 is illustrated. FIG. 3 is a schematic diagram illustrating a configuration of the cartridge storage portion 60, and is a schematic diagram when the printer 10 is viewed in the +Z direction in a state in which the housing 11 and the cover member 18 are removed. In FIG. 3, illustration of the controller 20, the ejection execution portion 30, and the medium conveyor 35 that are shown in FIG. 2 is omitted. In FIG. 3, an arrangement region LA, which is an arrangement position when the plurality of cartridges 100 are properly attached, is illustrated by one dot chain lines.

The printer 10 includes the controller 20, the ejection execution portion 30, the medium conveyor 35, the liquid receiver 40, and the cartridge storage portion 60 (FIG. 2). In the printer 10, liquid is supplied from the cartridges 100 stored in the cartridge storage portion 60 to the ejection execution portion 30 via supply tubes 42 of the liquid receiver 40. The ejection execution portion 30 discharges liquid onto a medium MP that the medium conveyor 35 has fed out from the medium storage 17 and is conveying, and as a result, a printing image is formed on the medium MP. The controller 20, the ejection execution portion 30, the medium conveyor 35, the liquid receiver 40, and the cartridge storage portion 60 will be described in order.

Controller

The controller 20 controls the driving of the constituent portions of the printer 10. The controller 20 is constituted by a microcomputer that includes at least a central processing unit and a main memory. The controller 20 exhibits various types of functions as a result of the central processing unit loading various types of programs into the main memory and executing them. The functions of the controller 20 will be described when appropriate.

Ejection Execution Portion

The ejection execution portion 30 includes a head 31 and a plurality of tubes 32 (FIG. 2). The head 31 receives various types of liquid from the liquid receiver 40 through the plurality of tubes 32. The supply mechanism of liquid from the liquid receiver 40 will be described later. The head 31 includes liquid chambers (illustration omitted) that each contain liquid supplied from the liquid receiver 40. Nozzles 33 that open downward are provided in a bottom face of each liquid chamber. The head 31 discharges liquid from each of the liquid chambers from the nozzles 33 using a known method such as by applying pressure to the ink using a piezo element, for example, under the control of the controller 20.

In the present embodiment, the head 31 is installed in a carriage 34, and is configured to linearly move back and forth in the X direction under the control of the controller 20. A two direction arrow PS indicating the moving direction and moving range of the head 31 is shown in FIG. 2. In the present embodiment, the main scanning direction of the printer 10 matches the X direction. The ejection execution portion 30 includes a guide shaft for guiding the movement of the carriage 34, a motor that generates a drive force, and a pulley for transmitting the drive force, as a drive mechanism for moving the head 31. Note that illustration and a detailed description of these constituent elements will be omitted.

The plurality of tubes 32 that are connected to the head 31 are flexible. The plurality of tubes 32 are arranged side by side in the Y direction. The plurality of tubes 32 are arranged substantially linearly in the +X direction from a joint 43, which is a connection part with the supply tubes 42 of the liquid receiver 40 and will be described later, along a scanning path of the head 31, curve upward, turn back in the −X direction, and then are connected to the head 31. The curved parts 32*r* of the plurality of tubes 32 are displaced in the X direction as the head 31 moves. Accordingly, interruption of the main scanning of the head 31 by the plurality of tubes 32 is suppressed, and the head 31 can move smoothly.

Medium Conveyor

The medium conveyor 35 conveys a medium MP, which is a processing target, under the control of the controller 20 (FIG. 2). The medium conveyor 35 includes a conveyance roller 36 that is provided to extend in the X direction below the head 31. The medium storage 17 described above is arranged below the conveyance roller 36. The medium conveyor 35 includes a feeding mechanism (illustration omitted) that feeds out the medium MP sheet by sheet from the medium storage 17 to the circumferential surface of the conveyance roller 36. The medium conveyor 35 rotates the conveyance roller 36 using a drive motor (illustration omitted), and moves the medium MP in the −Y direction below the head 31 using the rotational driving force. In the present embodiment, the sub scanning direction of the printer 10 matches the −Y direction. The medium MP that has passed below the head 31 is discharged to the outside of the printer 10 through the medium discharge port 14 (FIG. 1).

When print processing in the printer 10 is executed, the controller 20 causes the medium conveyor 35 to convey the medium MP in the sub scanning direction described above. Also, the controller 20 causes the head 31 to move back and forth in the main scanning direction along the conveyance roller 36 above the conveyance roller 36, and causes the head 31 to eject ink droplets toward the printing surface of the medium MP at a timing determined based on print data. Accordingly, ink dots are recorded at positions on the medium MP determined based on the print data, and an image is formed based on the print data.

Liquid Receiver

Figure 4:
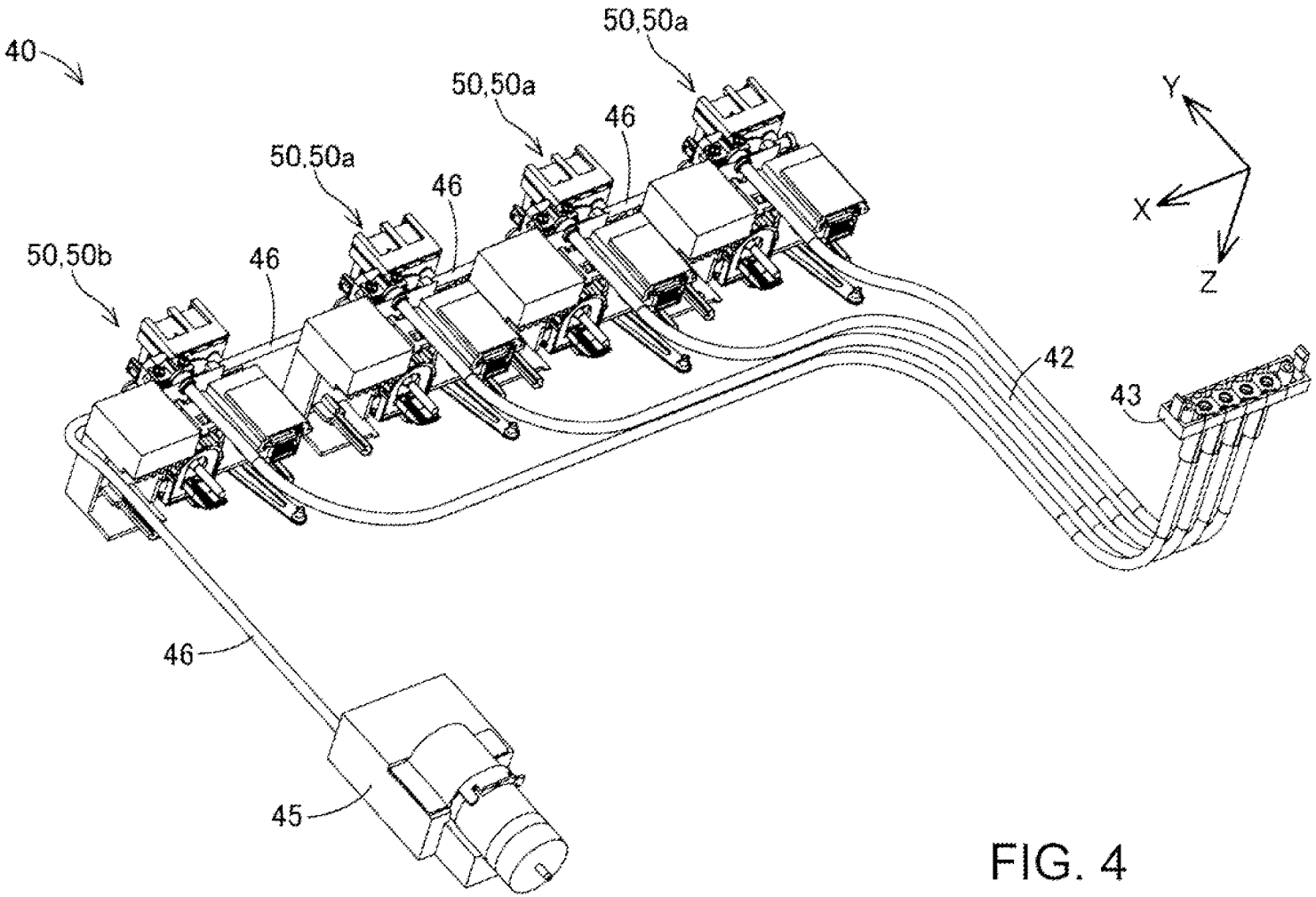
FIG. 4 is a schematic perspective view only illustrating a liquid receiver.

The liquid receiver 40 will be described with reference to FIG. 4 along with FIGS. 2 and 3. FIG. 4 is a schematic perspective view only illustrating the liquid receiver 40. The liquid receiver 40 includes a plurality of connection receivers 50, a pressure change generator 45, and pressure transmission piping 46, in addition to the plurality of supply tubes 42 and the joint 43 (FIGS. 3 and 4). First, the configuration of the plurality of connection receivers 50 will be described, then the supply tubes 42 and the joint 43 will be described. Also, the pressure change generator 45 and the pressure transmission piping 46 that constitute a liquid suction/sending out mechanism will be described.

Connection Receiver

The liquid receiver 40 is connected to the plurality of cartridges 100 (FIG. 2) that are stored in the cartridge storage portion 60 via the respective plurality of connection receivers 50. In the printer 10 of the present embodiment, four cartridges 100 of respective ink colors are attached, as will be described later. Therefore, in the present embodiment, the liquid receiver 40 includes four connection receivers 50 that respectively correspond to the four cartridges 100 (FIGS. 3 and 4).

The plurality of cartridges 100 include a first cartridge 100*a* whose capacity for containing liquid is small, and a second cartridge 100*b* whose capacity for containing liquid is large (FIG. 2). The plurality of connection receivers 50 includes a first connection receiver 50*a* corresponding to the first cartridge 100*a*, and a second connection receiver 50*b* corresponding to the second cartridge 100*b* (FIGS. 3 and 4). Three first cartridges 100*a* and one second cartridge 100*b* are attached to the printer 10 of the present embodiment. Therefore, the liquid receiver 40 of the present embodiment includes three first connection receivers 50*a* and one second connection receiver 50*b*.

In this specification, the first cartridge 100*a* and the second cartridge 100*b* are collectively referred to as "cartridge 100" when it is not necessary to distinguish them. Similarly, the first connection receiver 50*a* and the second connection receiver 50*b* are collectively referred to as "connection receiver 50" when it is not necessary to distinguish them. Note that, in the present embodiment, there is almost no substantial difference between the first connection receiver 50*a* and the second connection receiver 50*b* in terms of the configuration for connection to the cartridge 100.

The plurality of connection receivers 50 are installed at the end of the cartridge storage portion 60 on the +Y direction side (FIG. 3). The connection receivers 50 are arranged in a line in the X direction in the lowest portion at a position that is the deepest on the rear face side, in the printer 10. Each connection receiver 50 receives connection from the corresponding cartridge 100 on the −Y direction side. In the present embodiment, three first connection receivers 50*a* are installed side by side at almost the same intervals from the right side, and the second connection receiver 50*b* is installed on the left end side.

Figure 5:
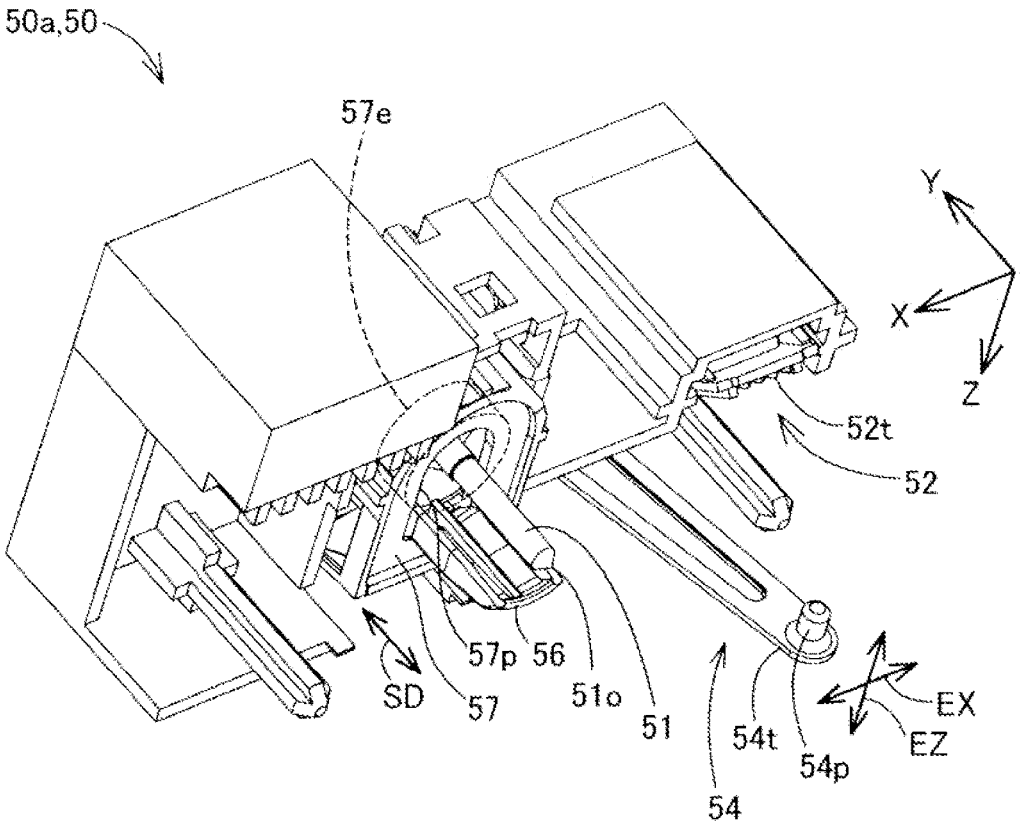
FIG. 5 is a schematic perspective view only illustrating a connection receiver included in the liquid receiver.

A schematic configuration of each connection receiver 50 will be described with reference to FIG. 5. FIG. 5 is a schematic perspective view illustrating only a portion of the first connection receiver 50*a* out of the plurality of connection receivers 50. The following description is common to the first connection receiver 50*a* and the second connection receiver 50*b* unless otherwise specified. The connection receiver 50 is configured as one component in which a liquid inlet 51, a device-side electrical connector 52, a device-side fixing structure 54, and a biasing member 57 are integrated.

Liquid flows into the liquid inlet 51 from the cartridge 100. In the present embodiment, the liquid inlet 51 protrudes in the −Y direction, at almost the center of the connection receiver 50 in the X direction. The liquid inlet 51 is constituted by a tube-shaped member having an elongated shape along the Y direction. A liquid introduction port 51*o* into which liquid flows is provided at a leading end of the liquid inlet 51 on the −Y direction side. The liquid inlet 51 is connected to the cartridge 100 as a result of the liquid introduction port 51*o* at the leading end thereof being inserted into a liquid supply port (described later) of the cartridge 100.

A rear end of the liquid inlet 51 on the +Y direction side is in communication with a pump chamber (illustration omitted) provided inside the connection receiver 50. The liquid that has flowed into the liquid inlet 51 flows into the pump chamber. Note that a backflow prevention valve structure (illustration omitted) for suppressing the backflow of liquid that has flowed into the pump chamber to the liquid inlet 51 is provided inside the connection receiver 50.

In the connection receiver 50 of the present embodiment, a liquid receiver 56 is provided below the liquid inlet 51. The liquid receiver 56 extends out in the −Y direction along the liquid inlet 51. The liquid receiver 56 functions as a receiver that receives liquid that has leaked from a connection part between the liquid inlet 51 and the cartridge 100. The liquid receiver 56 may be omitted.

The device-side electrical connector 52 is a connector that is to be electrically connected to the cartridge 100. In the present embodiment, the device-side electrical connector 52 is arranged so as to be oriented obliquely downward such that the normal vector of the surface thereof has a vector component in the −Y direction and a vector component in the +Z direction. The device-side electrical connector 52 is brought into contact with the cartridge-side electrical connector of the cartridge 100 in the −Y direction and +Z direction (details will be described later).

The device-side electrical connector 52 includes a plurality of terminal portions 52*t* that are arranged in the X direction. Each terminal portion 52*t* protrudes from the surface of the device-side electrical connector 52, and is brought into contact with the cartridge-side electrical connector (described later) of the cartridge 100 so as to be electrically connected thereto. Each terminal portion 52*t* is biased in the −Y direction by an elastic member (illustration omitted) such as a plate spring. In the present embodiment, each terminal portion 52*t* is also biased in the +Z direction in addition to the −Y direction. The device-side electrical connector 52 applies a biasing force in the −Y direction and +Z direction to the cartridge-side electrical connector of the cartridge 100 through the terminal portions 52*t*.

The device-side electrical connector 52 is connected to the controller 20 (FIG. 2) by wiring (illustration omitted). The wiring is constituted by a flexible flat cable, for example. As a result of the device-side electrical connector 52 and the cartridge-side electrical connector being electrically connected, electric signals are exchanged between the controller 20 and the cartridge 100. Accordingly, the controller 20 acquires information regarding the liquid contained in the cartridge 100. "Information regarding the liquid" includes the color and type of the ink, a parameter indicating the volume of the liquid in the cartridge 100, and the like, for example. Also, the controller 20 electrically detects the state of connection with the cartridge 100 by exchanging electric signals with the cartridge 100.

The device-side fixing structure 54 fixes, when a cartridge including an engaged portion is inserted to the cartridge storage portion 60, the cartridge as a fixing target, by applying a biasing force in the −Z direction. Note that the cartridge 100 of the present embodiment is a cartridge that is attached to the printer 10 to replace the cartridge that is the fixing target, and does not include an engaged portion. The cartridge 100 of the present embodiment is configured to be attached to the printer 10 without receiving a biasing force from the device-side fixing structure 54 (details will be described later). In this specification, the cartridge that is the fixing target of the device-side fixing structure 54 will not be described.

The device-side fixing structure 54 extends out toward the −Y direction side so as to be able to enter below the cartridge that is the fixing target described above. The device-side fixing structure 54 is configured as an arm-shaped member. The device-side fixing structure 54 is located on the −X direction side relative to the liquid inlet 51, and is located below the device-side electrical connector 52.

The device-side fixing structure 54 is biased in the −Z direction by an elastic member (illustration omitted) that is arranged inside the connection receiver 50. The device-side fixing structure 54, when a leading end 54*t* on the −Y direction side receives an external force in the Z direction, elastically pivots in the Z direction, as shown by an arrow EZ, with a rear end on the +Y direction side acting as a fulcrum. Also, the device-side fixing structure 54, when the leading end 54*t* receives an external force in the X direction, elastically pivots in the X direction, as shown by an arrow EX, with the rear end on the +Y direction side acting as a fulcrum.

The leading end 54*t* of the device-side fixing structure 54 is provided with a protrusion 54*p*. The protrusion 54*p* protrudes in the −Z direction, at the center of the leading end 54*t*. When a cartridge, which is a fixing target, is attached to the cartridge storage portion 60, the protrusion 54*p* comes into contact with an engaged portion provided in a lower face of the cartridge and engages therewith while applying a biasing force in the −Z direction. As a result of the engagement of the protrusion 54*p*, the movement of the cartridge, which is a fixing target, in the −Y direction is restricted. In this specification, the engagement mechanism of the device-side fixing structure 54 with respect to the engaged portion of a cartridge, which is a fixing target, will not be described.

A biasing member 57 is provided at a rear end of the liquid inlet 51 and the liquid receiver 56 on the +Y direction side. In order to firmly fix the cartridge, which is a fixing target of the device-side fixing structure 54 described above, the biasing member 57 comes into contact with the cartridge in the −Y direction, and applies a biasing force in the −Y direction. Note that the cartridge 100 of the present embodiment is configured to be attached to the printer 10 without receiving the biasing force from the biasing member 57, as will be described later.

The biasing member 57 is a resin member that includes a through hole 57*p* through which the liquid inlet 51 passes. The biasing member 57 is attached so as to be able to move in the Y direction. A coiled spring, which is an elastic member 57*e*, is arranged on a rear face side of the biasing member 57 so as to surround the vicinity of the liquid inlet 51, and applies a biasing force in the −Y direction to the biasing member 57. Accordingly, the biasing member 57, when pressed in the +Y direction, elastically moves in the Y direction, as shown by an arrow SD.

Supply Tube and Joint

The plurality of supply tubes 42 are each constituted by a flexible tube member made of resin (FIG. 4). The supply tubes 42 are connected to the respective pump chambers (illustration omitted) described above that are provided inside the respective connection receivers 50. The supply tubes 42 pass above a region in which cartridges 100 are stored from the respective connection receivers 50, are collected at an end on the −X direction side, and are routed side by side in the −Y direction (FIGS. 3 and 4). Then, the supply tubes 42 are routed in the −Z direction at an end of the printer 10 on the front side, and are connected to the joint 43 that is installed at a position higher than the medium conveyor 35 (FIGS. 2 and 4). As described above, the supply tubes 42 are connected to the respective corresponding plurality of tubes 32 of the ejection execution portion 30 via the joint 43.

Suction/Sending Out Mechanism of Liquid in Liquid Receiver

The pressure change generator 45 is a generator for generating a change in pressure in order to perform suction/sending out of liquid, and is constituted by a pump (FIGS. 2 and 3), for example. The pressure change generator 45 is installed above the cartridge storage portion 60 at a position close to the front face 12 of the printer 10. The pressure change generator 45 is located above the position at which the second cartridge 100*b* is to be attached. The pressure transmission piping 46 is connected to the pressure change generator 45, and transmits pressure that has been changed by the pressure change generator 45. The pressure transmission piping 46 is connected to pressure chambers (illustration omitted) provided inside the respective connection receivers 50.

The pressure chamber of each connection receiver 50 is adjacent to the pump chamber described above into which liquid flows from the cartridge 100 with a flexible film being interposed therebetween. Therefore, when the pressure change generator 45 has reduced the pressure in the pressure chamber, the flexible film warps toward the pressure chamber side, the volume of the pump chamber increases, and the liquid in the cartridge 100 is suctioned to the pump chamber via the liquid inlet 51. On the other hand, when the pressure change generator 45 increases the pressure in the pressure chamber, the flexible film warps toward the pump chamber side, the volume of the pump chamber decreases, and the liquid that has flowed into the pump chamber is pushed out to the supply tube 42. In this way, in the liquid receiver 40, as a result of the pressure change generator 45 repeatedly increasing and decreasing the pressure in the pressure chamber, suction of liquid from the cartridge 100 and supply of liquid to the ejection execution portion 30 can be realized.

Cartridge Storage Portion/Liquid Supply Unit

In the printer 10 of the present embodiment, the cartridge storage portion 60 is provided at a lowest portion (FIGS. 1 to 3). The plurality of cartridges 100 are inserted in the +Y direction into the cartridge storage portion 60 (FIGS. 2 and 3). Rails that guide the movement of cartridges 100 along the Y direction and rollers that rotate in the Y direction are provided (illustration omitted) in a bottom face of the cartridge storage portion 60. The plurality of cartridges 100 are stored in the cartridge storage portion 60 in a state of being arranged in a line in the X direction. In the printer 10, the cartridge storage portion 60 and the plurality of cartridges 100 constitute the liquid supply unit 70 that supply liquid to the ejection execution portion 30 via the liquid receiver 40.

In the cartridge storage portion 60 of the present embodiment, the second cartridge 100*b* is stored at the end on the +X direction side, and three first cartridges 100*a* are stored on the −X direction side thereof (FIG. 2). One corresponding connection receiver 50 is installed on the +Y direction side of the arrangement region LA of each cartridge 100 (FIG. 3). As described above, in the present embodiment, the cartridges 100 respectively contain ink of different colors. The combination of colors of ink that are respectively contained in the cartridges 100 is not specifically limited. For example, the three first cartridges 100*a* may respectively contain cyan ink, magenta ink, and yellow ink, and the second cartridge 100*b* may contain black ink whose consumption amount is estimated to be the largest. Note that some of or all of the cartridges 100 may contain ink of the same color. Attachment and detachment of the cartridges 100 to and from the printer 10 will be described in detail later.

An opening member 62 is installed at an end on the −Y direction side of the cartridge storage portion 60 (FIG. 2). The opening member 62 is a plate member having a substantially rectangular shape, and is provided with a plurality of through holes 63, which are insertion ports through which the cartridge 100 are inserted. The opening member 62 is fixedly installed in a state in which the thickness direction thereof matches the Y direction and the longitudinal direction matches the X direction. Each through hole 63 has an opening shape corresponding to the circumferential contour shape of the corresponding cartridge 100 to be inserted thereto when viewed in the Y direction. The insertion and drawing out of the cartridge 100 relative to the printer 10 is guided by the opening member 62. Also, the occurrence of cases where the first cartridge 100*a* and the second cartridge 100*b* are inserted to the wrong places can be suppressed. The opening member 62 may be omitted.

A lower wall 65 is formed so as to extend along the X direction at an end of the cartridge storage portion 60 on the −Y direction side, at a position on the +Y direction side relative to the opening member 62 (FIG. 3). The lower wall 65 is located at a position lower than the cartridges 100 in an attached state of being attached to the cartridge storage portion 60. Also, the lower wall 65 is located on the −Y direction side relative to rear faces (described later) of the cartridges 100 in an attached state. Recesses 66 that recede in the +Z direction are formed on the +Y direction side of the lower wall 65. Each recess 66 functions as an engaged portion with which an engagement portion of a lock mechanism 140 (FIG. 2) of a cartridge 100 engages (details will be described later).

Configuration of Cartridge

A configuration of the first cartridge 100*a* will be described with reference to FIGS. 6 and 7. Thereafter, a configuration of the second cartridge 100*b* will be described with reference to FIG. 8.

First Cartridge

Figure 6:
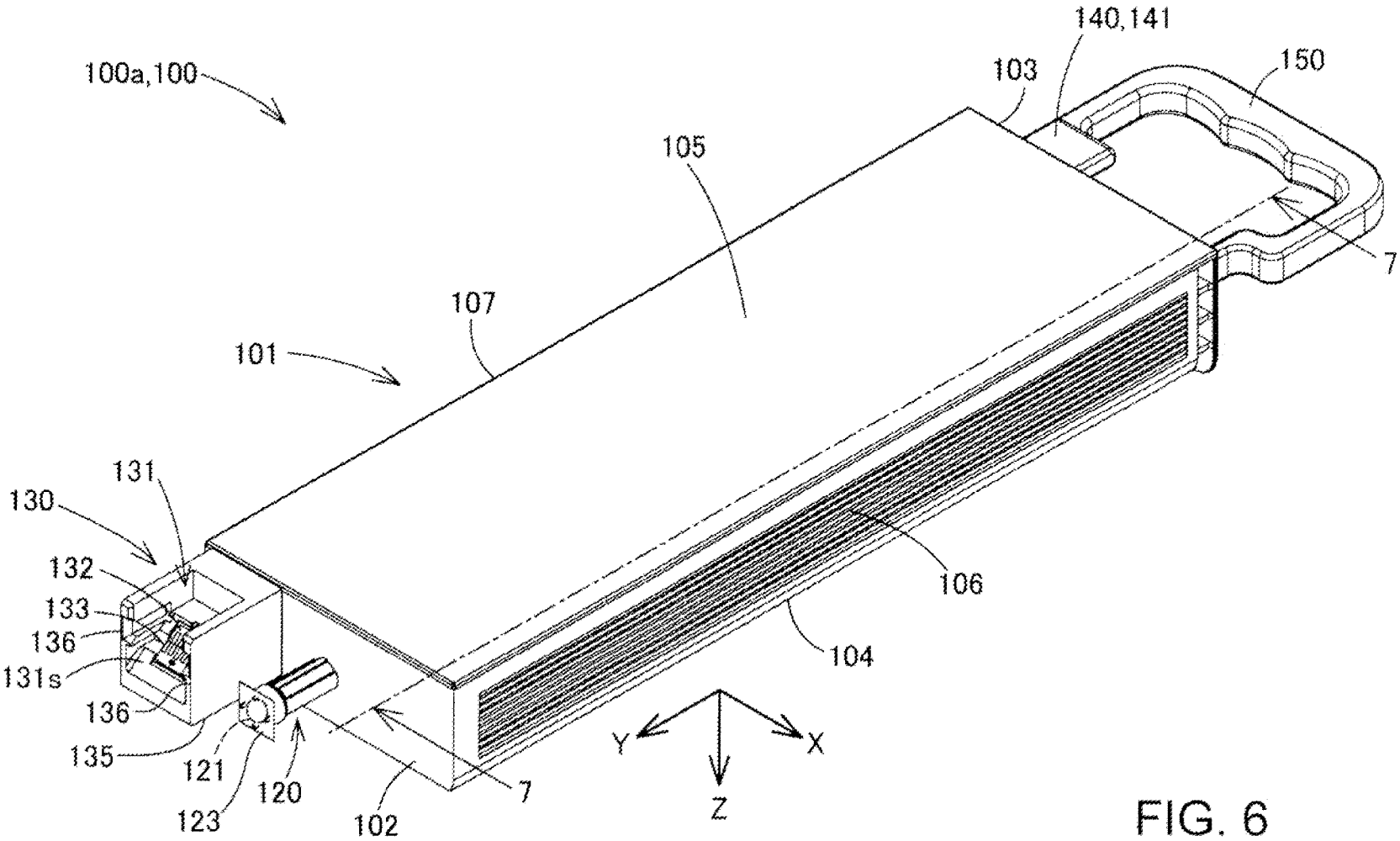
FIG. 6 is a schematic perspective view illustrating a configuration of a first cartridge.

FIG. 6 is a schematic perspective view illustrating a configuration of the first cartridge 100*a*. FIG. 7 is a schematic cross-sectional view of the first cartridge 100*a* taken along line 7-7 shown in FIG. 6. The first cartridge 100*a* includes a main body 101 substantially having a rectangular parallelepiped shape with the Y direction being a longitudinal direction. In the present embodiment, the main body 101 is a case configured as a hollow casing for storing the liquid container 110 (FIG. 7) therein. The main body 101 is made of a resin member such as polypropylene, for example. The shock resistance of the first cartridge 100*a* is improved due to having the main body 101.

The main body 101 includes a front face 102, a rear face 103, a lower face 104, an upper face 105, and two side faces 106 and 107. The front face 102 is located on a leading end side in an attachment direction (+Y direction) of the first cartridge 100*a*, and faces in the +Y direction in an attached state of being attached to the printer 10 (FIGS. 6 and 7). The rear face 103 is located on a rear end side in the attachment direction of the first cartridge 100*a*. The rear face 103 is located on a side opposite to the front face 102 in the Y direction, and faces the −Y direction (FIGS. 6 and 7).

Figure 7:
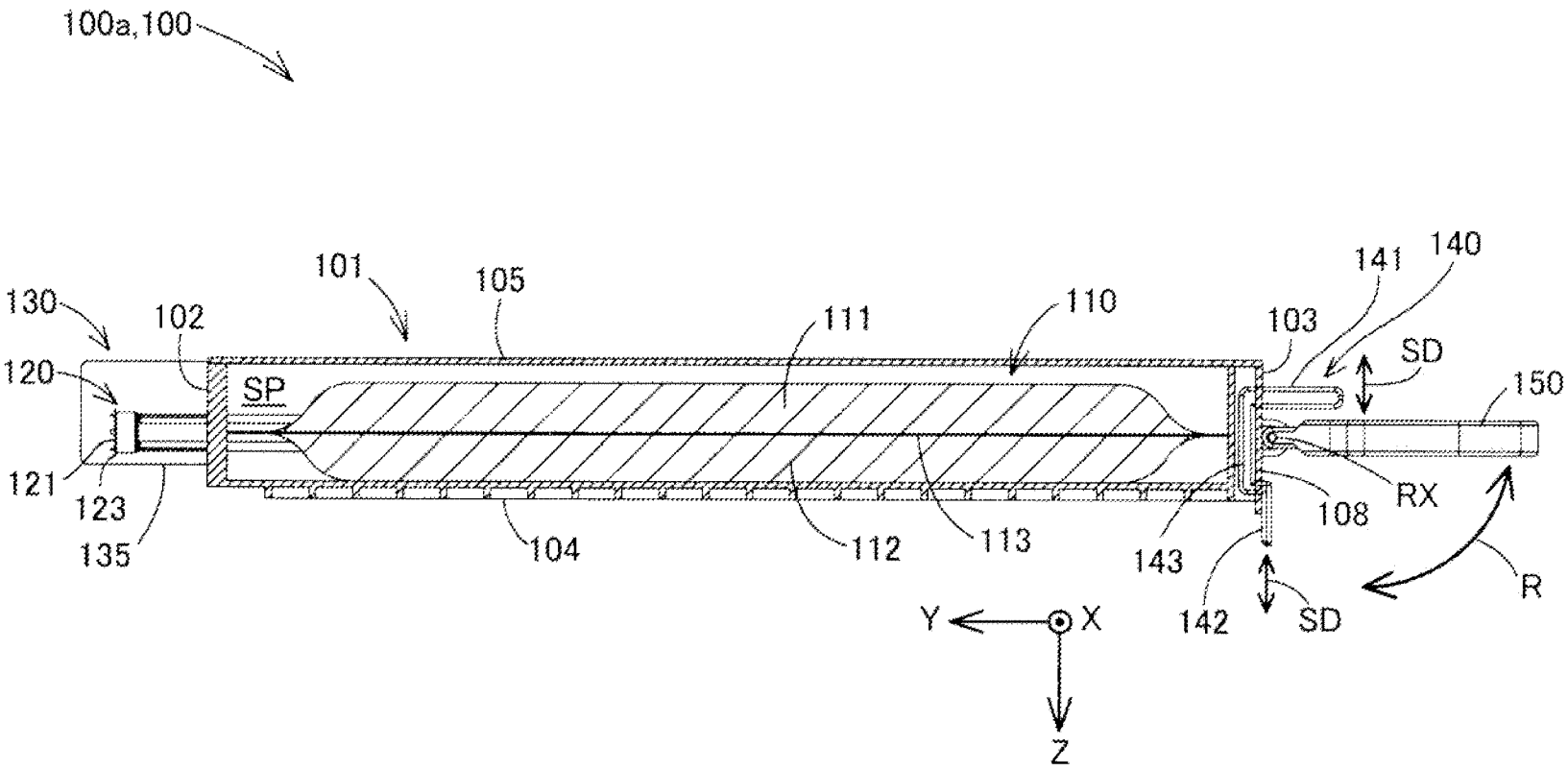
FIG. 7 is a schematic cross-sectional view illustrating an inner structure of the first cartridge.

The lower face 104 intersects the front face 102 and the rear face 103, and faces in the +Z direction (FIGS. 6 and 7). The upper face 105 intersects the front face 102 and the rear face 103, is located on a side opposite to the lower face 104 in the Z direction, and faces in the −Z direction (FIGS. 6 and 7).

The first side face 106 intersects the front face 102, the rear face 103, the lower face 104, and the upper face 105, and faces in the +X direction (FIG. 6). The first side face 106 is located on a left side when viewed facing toward the rear face 103. The second side face 107 is located on a side opposite to the first side face 106 in the X direction (FIG. 6). The second side face 107 intersects the front face 102, the rear face 103, the lower face 104, and the upper face 105, and faces in the −X direction. The second side face 107 is located on a right side when viewed facing toward the rear face 103.

Each of the faces 102 to 107 of the main body 101 is not necessarily a flat face, and may be curved as a whole, or include a recess, a protrusion, or a through hole. The directions that the respective faces 102 to 107 face each mean a direction substantially specified when the corresponding face is viewed as a whole. Also, in this specification, two faces "intersecting" means any of a state in which the two faces actually intersect each other, a state in which an extension of one of the faces intersects the other face, and a state in which extensions of two faces intersect. Therefore, a chamfered portion or the like that constitutes a curved face or an inclined face may be interposed between two faces intersecting each other at a corner at which the two faces intersect, for example.

In the present embodiment, the width of the main body 101 in the Z direction is smaller than the width in the X direction and the width in the Y direction. The "width" in each direction means a distance between parts that are located on the most outside of the main body 101 in the direction. The first cartridge 100*a* has a thin flat shape, and the stability of the arrangement posture when attached to the printer 10 is improved.

As described above, the above-described liquid container 110 is accommodated in an inner space SP of the main body 101 (FIG. 7). In the present embodiment, the liquid container 110 is constituted by a flexible bag-like member. Two sheet members 111 and 112 each having a substantially rectangular outline with the Y direction being a longitudinal direction are overlaid in the Z direction, the outer peripheral ends 113 thereof are adhered, and as a result the liquid container 110 is formed. The first sheet member 111 is arranged on the −Z direction side, and the second sheet member 112 is arranged on the +Z direction side. The sheet members 111 and 112 are made of a flexible material having gas barrier properties and liquid impermeability. The sheet members 111 and 112 are constituted by a film member such as polyethylene terephthalate (PET), nylon, or polyethylene, for example. Since the liquid container 110 has gas barrier properties, the airtightness of the liquid container 110 is improved, and the degradation of liquid such as a change in density of the liquid due to the evaporation of the liquid can be suppressed.

The first cartridge 100*a* includes a liquid outlet 120 and a cartridge-side electrical connector 130, in the front face 102 (FIGS. 6 and 7). In the present embodiment, the liquid outlet 120 is configured as a tube-shaped part that protrudes in the +Y direction at the approximate center of the front face 102 (FIG. 6). A rear end of the liquid outlet 120 on the −Y direction side is connected to the liquid container 110 (FIG. 7). The liquid outlet 120 is connected to the liquid inlet 51 (FIG. 5), and supplies liquid in the liquid container 110 to the liquid inlet 51.

A liquid supply port 121 for supplying liquid in the liquid container 110 to the liquid inlet 51 is open at a leading end of the liquid outlet 120 on the +Y direction side (FIG. 6). A leading end of the liquid inlet 51 (FIG. 5) of the printer 10 is inserted in the +Y direction into the liquid supply port 121 (described later). In FIGS. 6 and 7, the liquid supply port 121 is sealed by an adhered film member 123. The film member 123 may be omitted. Because the liquid supply port 121 is provided at a position separated from the front face 102, staining of the front face 102 by liquid is suppressed. Also, the liquid attached to a peripheral edge of the liquid supply port 121 can be easily viewed, and as a result, liquid being attached to a finger of the user by accident or the like can be suppressed.

The cartridge-side electrical connector 130 is provided next to the liquid outlet 120 in the X direction (FIG. 6). The cartridge-side electrical connector 130 is provided as a protrusion having a substantially rectangular parallelepiped shape that protrudes from the front face 102 in the +Y direction. The cartridge-side electrical connector 130 is to be electrically connected to the device-side electrical connector 52 (FIG. 5).

A recess 131 that is open in the +Y direction and the −Z direction is formed on a leading end side of the cartridge-side electrical connector 130. An inclined surface 131*s* that faces obliquely upward in a direction between the +Y direction and the −Z direction is formed inside the recess 131, and a circuit board 132 is placed on the inclined surface 131*s*. Hereinafter, the recess 131 may be referred to as "circuit board placement portion 131" as well.

A plurality of electrode plates 133 that are brought into electrical contact with the respective terminal portions 52*t* (FIG. 5) of the device-side electrical connector 52 are arranged on a surface of the circuit board 132. The plurality of electrode plates 133 are arranged at positions corresponding to the terminal portions 52*t* of the device-side electrical connector 52. The circuit board 132 is arranged so as to face obliquely upward on the inclined surface 131*s*, and the normal vector of the surface of each of the electrode plates 133 has a vector component in the +Y direction and a vector component in the −Z direction. Accordingly, favorable electrical connection with the device-side electrical connector 52 can be established (details will be described later).

A bottom face 135 (FIG. 7), of the cartridge-side electrical connector 130, that faces in the +Z direction is located on the −Z direction side relative to the lower face 104 of the main body 101 via a step. When the first cartridge 100*a* is attached to the cartridge storage portion 60, the device-side fixing structure 54 (FIG. 5) of the first connection receiver 50*a* is arranged in a region below the bottom face 135 without coming into contact with the bottom face 135 (details will be described later).

In the present embodiment, on a back side of the circuit board 132, a memory for storing information regarding the liquid, a circuit for detecting connection with the device-side electrical connector 52, and the like are embedded inside the cartridge-side electrical connector 130 (illustration and detailed description will be omitted). Also, in the present embodiment, the circuit board 132 is installed at a receded position of the cartridge-side electrical connector 130, and is sandwiched between two side walls 136 that protrude in the −Z direction and +Y direction relative to the circuit board 132, on both sides in the X direction. These side walls 136 function as a protector of the circuit board 132, and as a result, cases such as a user touching the circuit board 132 by accident and the circuit board 132 being damaged when a user drops the first cartridge 100*a* by accident can be suppressed.

The rear face 103 of the first cartridge 100*a* is provided with a lock mechanism 140 (FIGS. 6 and 7). The lock mechanism 140 includes an operation portion 141, an engagement portion 142, and a connector 143 (FIG. 7). The operation portion 141 protrudes in the −Y direction at a position on the −Z direction side of the rear face 103 such that it can be operated by a user. The engagement portion 142 extends out in the +Z direction at a position on the +Z direction side of the rear face 103, and protrudes below the lower face 104. The connector 143 is arranged on a back side of a rear wall 108 that constitutes the rear face 103. The connector 143 extends along the Z direction, and connects an end of the operation portion 141 on the +Y direction side and an end of the engagement portion 142 on the −Z direction side.

The lock mechanism 140 is installed so as to be able to be displaced in the Z direction relative to the main body 101, as shown by an arrow SD (FIG. 7). When a user hooks his/her finger to the operation portion 141 and slides it, the position of a lower end of the engagement portion 142 on the +Z direction side is displaced in the Z direction according to the sliding. A state in which the operation portion 141 is at a specified lower end position on the +Z direction side is the "locked state" of the lock mechanism 140, and a state in which the operation portion 141 is at a specified upper end position on the −Z direction side is the "released state" of the lock mechanism 140.

In the liquid supply unit 70 (FIGS. 2 and 3) of the present embodiment, after the first cartridge 100*a* is inserted into the cartridge storage portion 60, a user presses down the operation portion 141 such that the lock mechanism 140 enters the locked state, and as a result, the engagement portion 142 engages with the printer 10. Accordingly, movement of the first cartridge 100*a* in the −Y direction relative to the printer 10 is restricted, and the first cartridge 100*a* is fixed to the printer 10. The mechanism of fixing the first cartridge 100*a* using the lock mechanism 140 will be described later.

The rear face 103 of the first cartridge 100*a* is provided with a gripper 150 that a user will hold (FIGS. 6 and 7). In the present embodiment, the gripper 150 is configured as a handle by a frame member having a substantially rectangular shape with the X direction being a longitudinal direction (FIG. 6). The gripper 150 is attached to the rear face 103 so as to be able to pivot about a pivoting shaft RX provided at an end on the +Y direction side, as shown by an arrow R (FIG. 7). A user can carry the first cartridge 100*a* before attaching it to the printer 10, by holding the gripper 150. Also, a user can draw out the first cartridge 100*a* that has been inserted into the cartridge storage portion 60 by holding the gripper 150 (FIG. 2).

Second Cartridge

Figure 8:
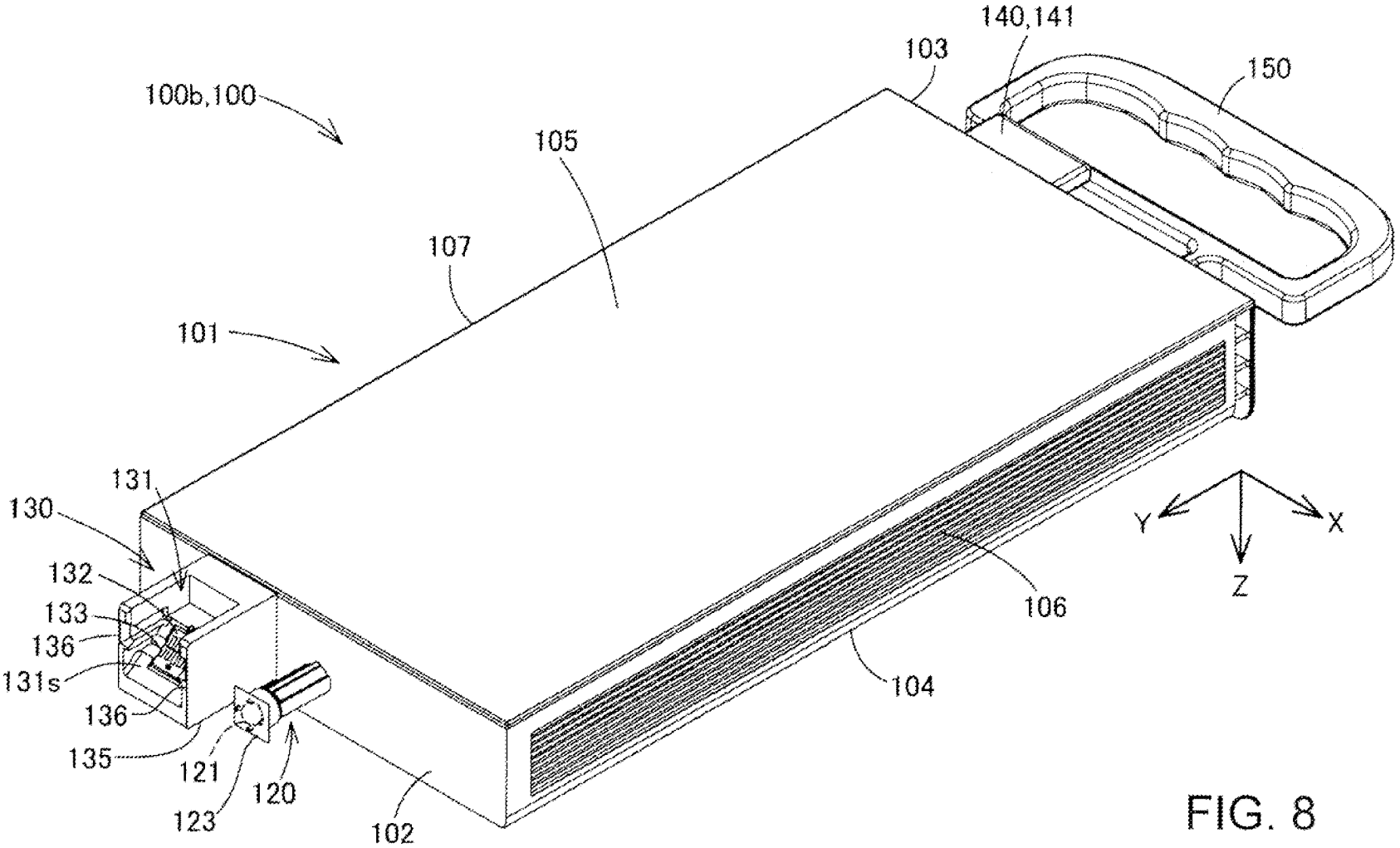
FIG. 8 is a schematic perspective view illustrating a configuration of a second cartridge.

FIG. 8 is a schematic perspective view illustrating an upper face side of the second cartridge 100*b*. In FIG. 8 and the following description, constituent portions that are the same as or corresponding to the various constituent portions of the first cartridge 100*a* will be denoted by the same reference signs. Such constituent portions denoted by the same reference signs each perform the same function in the second cartridge 100*b* as the function that the corresponding constituent portion performs in the first cartridge 100*a*. Therefore, various effects described in the first cartridge 100*a* described above can also be obtained in the second cartridge 100*b* by the corresponding constituent portions.

The second cartridge 100*b* is configured almost the same as the first cartridge 100*a* excluding the points described later. In the second cartridge 100*b*, a main body 101, a liquid container 110 (illustration omitted) that is accommodated in the main body 101, and a gripper 150 each have a width in the X direction larger than the width of the main body 101 in the first cartridge 100*a*. The second cartridge 100*b* has an increased width in the X direction, and as a result, the amount of liquid that can be contained is increased relative to the first cartridge 100*a*.

Attachment Mechanism of Cartridge

Figure 9:
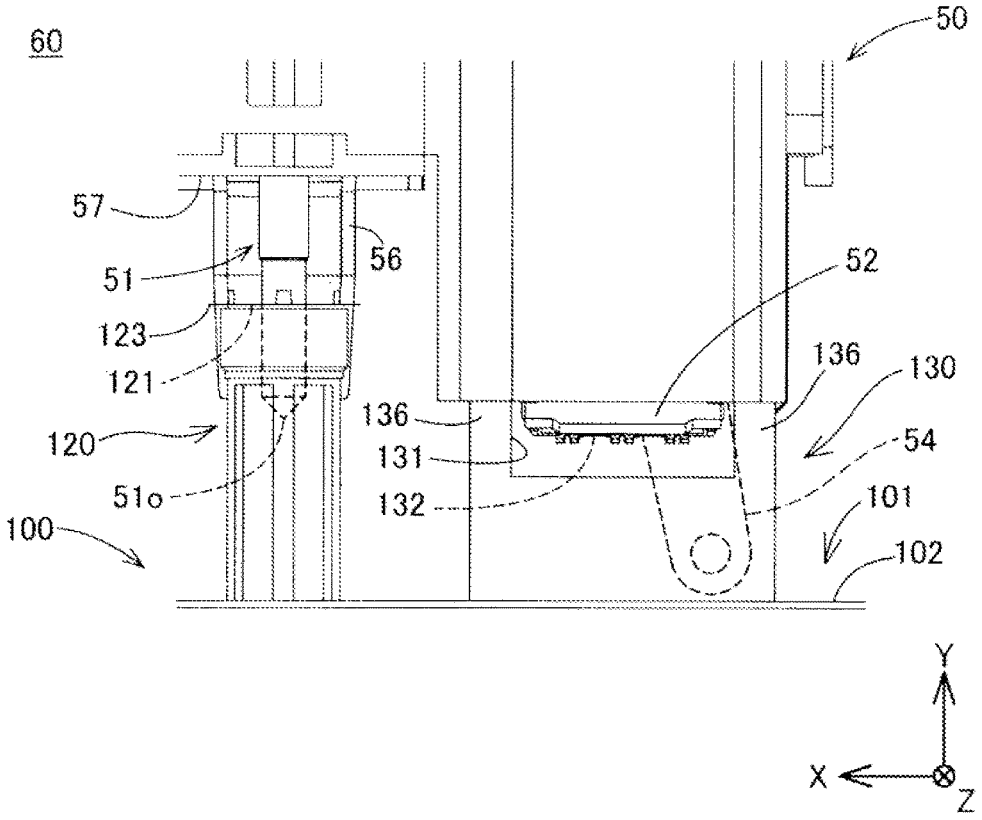
FIG. 9 is a schematic diagram illustrating a connection state of a liquid sending out portion and a cartridge-side electrical connector.

An attachment mechanism of the cartridge 100 to the printer 10 will be described with reference to FIGS. 9, 10A, and 10B, in order. FIG. 9 is a schematic diagram illustrating a state of connection of the liquid outlet 120 and the cartridge-side electrical connector 130 of the cartridge 100 to the liquid inlet 51 and the device-side electrical connector 52 of the printer 10. FIG. 9 only shows the region A in FIG. 3 when the cartridge 100 is connected to the connection receiver 50. The following description is common between the first cartridge 100*a* and the second cartridge 100*b*.

The cartridge 100 is inserted in the +Y direction toward a specified arrangement region LA in the cartridge storage portion 60. Then, the liquid outlet 120 provided in the front face 102 of the cartridge 100 is connected to the liquid inlet 51 included in the connection receiver 50 of the printer 10. Also, the cartridge-side electrical connector 130 provided in the front face 102 as well is connected to the device-side electrical connector 52 included in the connection receiver 50 of the printer 10.

In the present embodiment, the liquid supply port 121 of the liquid outlet 120 and the cartridge-side electrical connector 130 are provided at a position separated on the +Y direction side relative to the front face 102. Therefore, accidentally bringing the main body 101 into contact with the liquid inlet 51 or the device-side electrical connector 52 is suppressed. Accordingly, degradation such as damage to the liquid inlet 51 or the device-side electrical connector 52 due to coming into contact with the main body 101 can be suppressed. Also, staining of the main body 101 by liquid attached to the liquid inlet 51 due to coming into contact with the liquid inlet 51 can be suppressed.

When the liquid outlet 120 of the cartridge 100 and the liquid inlet 51 of the printer 10 are connected, the leading end of the liquid inlet 51 passes through the film member 123 and is inserted into the liquid supply port 121 at the leading end of the liquid outlet 120. Accordingly, the liquid outlet 120 of the cartridge 100 and the liquid inlet 51 of the printer 10 are connected, the liquid contained in the liquid container 110 (FIG. 7) is supplied to the liquid inlet 51 via the liquid supply port 121 of the liquid outlet 120.

When the cartridge-side electrical connector 130 of the cartridge 100 and the device-side electrical connector 52 of the printer 10 are connected, the two side walls 136 of the cartridge-side electrical connector 130 sandwich, in the X direction, the device-side electrical connector 52. Then, each electrode plate 133 (FIGS. 6 and 8) of the circuit board 132 is brought into electrical contact with the corresponding terminal portion 52*t* (FIG. 5) of the device-side electrical connector 52. Accordingly, electric signals can be exchanged between the cartridge 100 and the printer 10. Note that, in FIG. 9, the circuit board 132 is hidden under the device-side electrical connector 52 and is barely visible, and therefore the reference sign is added to the arrangement position by a broken line.

In the present embodiment, each electrode plate 133 receives a biasing force, from the corresponding terminal portion 52*t*, in the −Y direction in reaction to a pressing force in the +Y direction when the cartridge 100 is attached, and as a result the electrode plate 133 is bought into contact with the corresponding terminal portion 52*t*. Accordingly, the device-side electrical connector 52 can be brought into tight contact with the cartridge-side electrical connector 130, and a favorable state of electrical connection with the cartridge-side electrical connector 130 is established.

In addition, in the present embodiment, the circuit board 132 is arranged so as to face obliquely upward such that the surface thereof faces in the −Z direction (FIGS. 6 and 8). Also, each terminal portion 52*t* (FIG. 5) of the device-side electrical connector 52 is biased in the +Z direction as well. Therefore, when the cartridge-side electrical connector 130 and the device-side electrical connector 52 are electrically connected, each electrode plate 133 (FIGS. 6 and 8) of the circuit board 132 receives a biasing force, from the corresponding terminal portion 52*t* of the device-side electrical connector 52, in the +Z direction in addition to the biasing force in the −Y direction described above. The device-side electrical connector 52 can be brought into tighter contact with the cartridge-side electrical connector 130 by this biasing force, and as a result, the electrical connectability to the cartridge-side electrical connector 130 can be improved.

In the present embodiment, when the cartridge-side electrical connector 130 and the device-side electrical connector 52 are connected, the leading end of the terminal portions 52*t* of the device-side electrical connector 52 move while sliding over a contact surface of the corresponding electrode plate 133 of the cartridge-side electrical connector 130, and then the connection is completed. As a result of sliding the terminal portions 52*t*, foreign matter such as an oil composition and dust adhered to the contact surface of the electrode plates 133 of the cartridge-side electrical connector 130 are removed by the terminal portions 52*t* of the device-side electrical connector 52. Accordingly, an increase in the contact resistance between the cartridge-side electrical connector 130 and the device-side electrical connector 52 due to adhesion of such foreign matter can be suppressed.

In the present embodiment, when the lock by the lock mechanism 140, which will be described later, is released in order to take out the cartridge 100 from the cartridge storage portion 60, the movement of the cartridge 100 in the −Y direction is assisted by the biasing force, in the −Y direction, from the device-side electrical connector 52. Accordingly, the cartridge 100 can be easily taken out from the cartridge storage portion 60.

In the present embodiment, the device-side fixing structure 54 and the biasing member 57 of the connection receiver 50 are located on the +Y direction side relative to the front face 102 of the cartridge 100 when the cartridge 100 is attached. The arm shaped device-side fixing structure 54 that extends in the −Y direction does not reach the main body 101 of the cartridge 100, despite entering a gap below the bottom face 135 of the cartridge-side electrical connector 130. Also, the biasing member 57 is provided at the rear end of the liquid inlet 51 where the leading end of the liquid outlet 120 does not reach, and is located at a position so as to not directly coming into contact with the main body 101 of the cartridge 100.

In this way, the cartridge 100 of the present embodiment is attached to the printer 10 without the main body 101 receiving a biasing force from each of the device-side fixing structure 54 and the biasing member 57. Accordingly, a user can attach the cartridge 100 to the printer 10 in a state in which receiving of an extra biasing force other than the biasing force from the device-side electrical connector 52 described above is suppressed. The user can attach the cartridge 100 to the printer 10 with a force smaller than the force needed to attach a cartridge, which is a fixing target that is fixed by receiving biasing forces from the device-side fixing structure 54 and the biasing member 57, to the printer 10. Therefore, the user can easily attach the cartridge 100 to the printer 10.

Figure 10A:
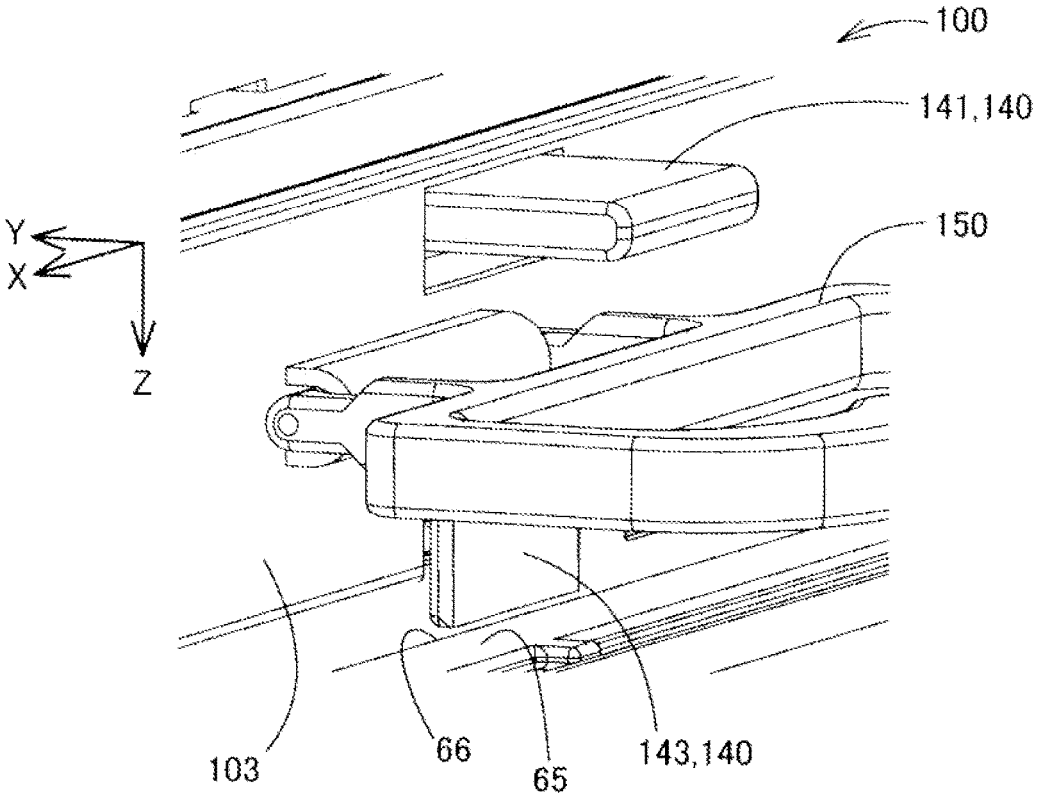
FIG. 10A is a schematic perspective view illustrating a lock mechanism in a released state.
Figure 10B:
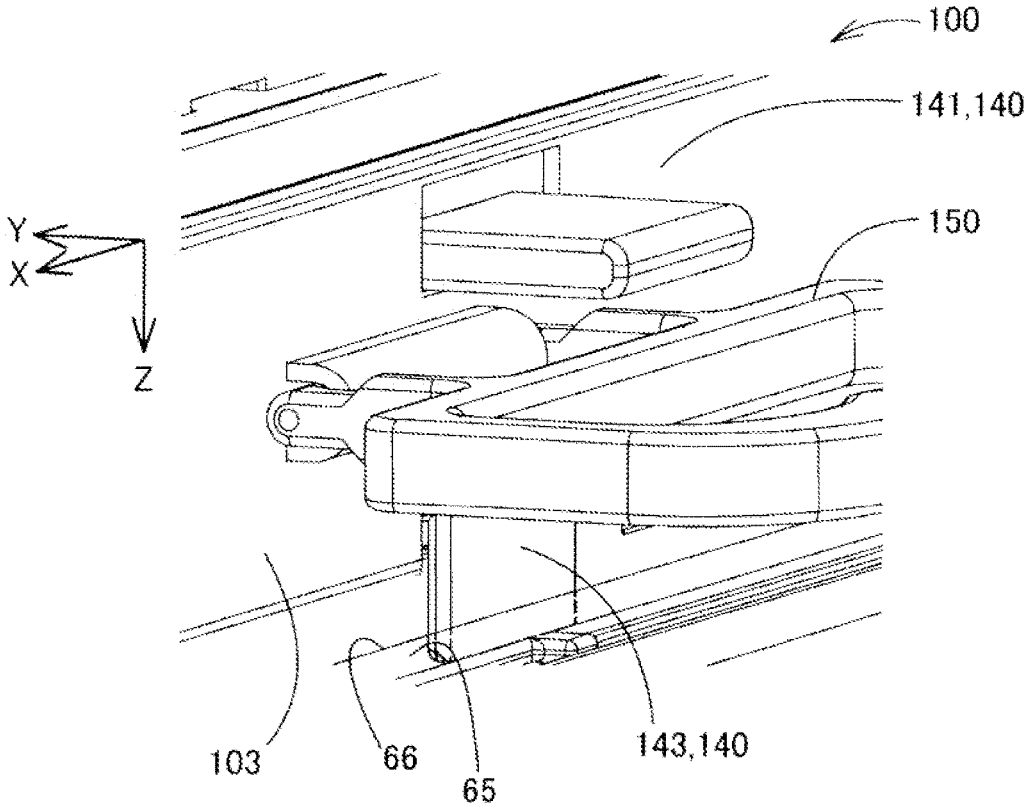
FIG. 10B is a schematic perspective view illustrating the lock mechanism in a locked state.

FIGS. 10A and 10B are schematic diagrams illustrating a locking operation of the cartridge 100 as per the lock mechanism 140. FIG. 10A shows the lock mechanism 140 in a released state, and FIG. 10B shows a lock mechanism 140 in a locked state. The cartridge 100 is attached to the printer 10 in a state of receiving a biasing force at least in the −Y direction from the device-side electrical connector 52, as described above. Therefore, it is desirable that the movement of the cartridge 100 in the −Y direction is restricted when in an attached state. In the cartridge 100 of the present embodiment, a user operates the lock mechanism 140 provided in the rear face 103 such that the lock mechanism 140 is brought into a locked state, and as a result, movement of the cartridge 100 in the −Y direction is restricted.

The cartridge 100 is pushed in the +Y direction with respect to the cartridge storage portion 60 (FIG. 10A), in a released state in which the operation portion 141 of the lock mechanism 140 is located at an upper end position on the −Z direction side, until the rear face 103 reaches a position at the end of the cartridge storage portion 60 on the −Y direction side. At this time, when the user presses down the operation portion 141 to the lowest position and brings the lock mechanism 140 into a locked state, the lower end of the engagement portion 142 is displaced in the +Z direction (FIG. 10B). Accordingly, the lower end of the engagement portion 142 enters into a recess 66 that is located on the +Y direction side of the lower wall 65, the engagement portion 142 engages with the recess 66, and the movement of the cartridge 100 in the −Y direction is restricted. Therefore, the arrangement position of the cartridge 100 is fixed, and the state of connection to the cartridge 100 with the connection receiver 50 is maintained. Note that, when the cartridge 100 is taken out from the cartridge storage portion 60, the user moves the operation portion 141 to the upper end position so as to bring the lock mechanism 140 to a released state, and as a result, the user can draw out the cartridge 100 in the −Y direction while holding the gripper 150.

In the cartridge 100 of the present embodiment, the lock mechanism 140 is provided in the rear face 103 of the cartridge 100 that can be easily accessed by a user. Therefore, the user can easily perform an operation to fix the cartridge 100. Because the lock mechanism 140 is made of a single member and has a relatively simple configuration, the lock mechanism 140 is less likely to malfunction compared with a case in which the lock mechanism is configured by combining a plurality of members. Accordingly, the occurrence of cases in which the operation to attach and detach the cartridge 100 becomes difficult due to a malfunction of the lock mechanism 140 can be suppressed. Also, even if the lock mechanism 140 malfunctions, since the lock mechanism 140 is provided at a position that is exposed from the cartridge storage portion 60 and can be viewed by a user, the malfunction can be easily resolved.

Here, the cartridge 100 of the present embodiment receives, in an attached state, a biasing force in the +Z direction from the device-side electrical connector 52, at the cartridge-side electrical connector 130 on the front face 102 side, as described above. In contrast, the lock mechanism 140 is provided in the rear face 103 that is separate from the cartridge-side electrical connector 130. Therefore, the occurrence of cases in which the operation of the lock mechanism 140 is affected by a moment generated by the biasing force in the +Z direction can be suppressed.

Summary of First Embodiment

As described above, according to the cartridge 100 of the present embodiment and the liquid supply unit 70 to which the cartridge 100 is attached, the cartridge-side electrical connector 130 is connected to the device-side electrical connector 52 while receiving a biasing force in the −Y direction. Accordingly, the cartridge-side electrical connector 130 and the device-side electrical connector 52 are tightly connected, and a favorable electrical connection state can be established. Also, movement of the cartridge 100 is restricted by the lock mechanism 140 while receiving a biasing force from the device-side electrical connector 52, and as a result, the cartridge 100 can be kept in a state of being tightly connected to the printer 10. Also, the cartridge 100 can be easily attached to the printer 10, because the cartridge 100 does not receive a biasing force from the device-side fixing structure 54 or the biasing member 57. In addition, according to the cartridge 100 of the present embodiment and the liquid supply unit 70 to which the cartridge 100 is attached, various effects described in the first embodiment described above can be obtained.

B. Second Embodiment

Figure 11:
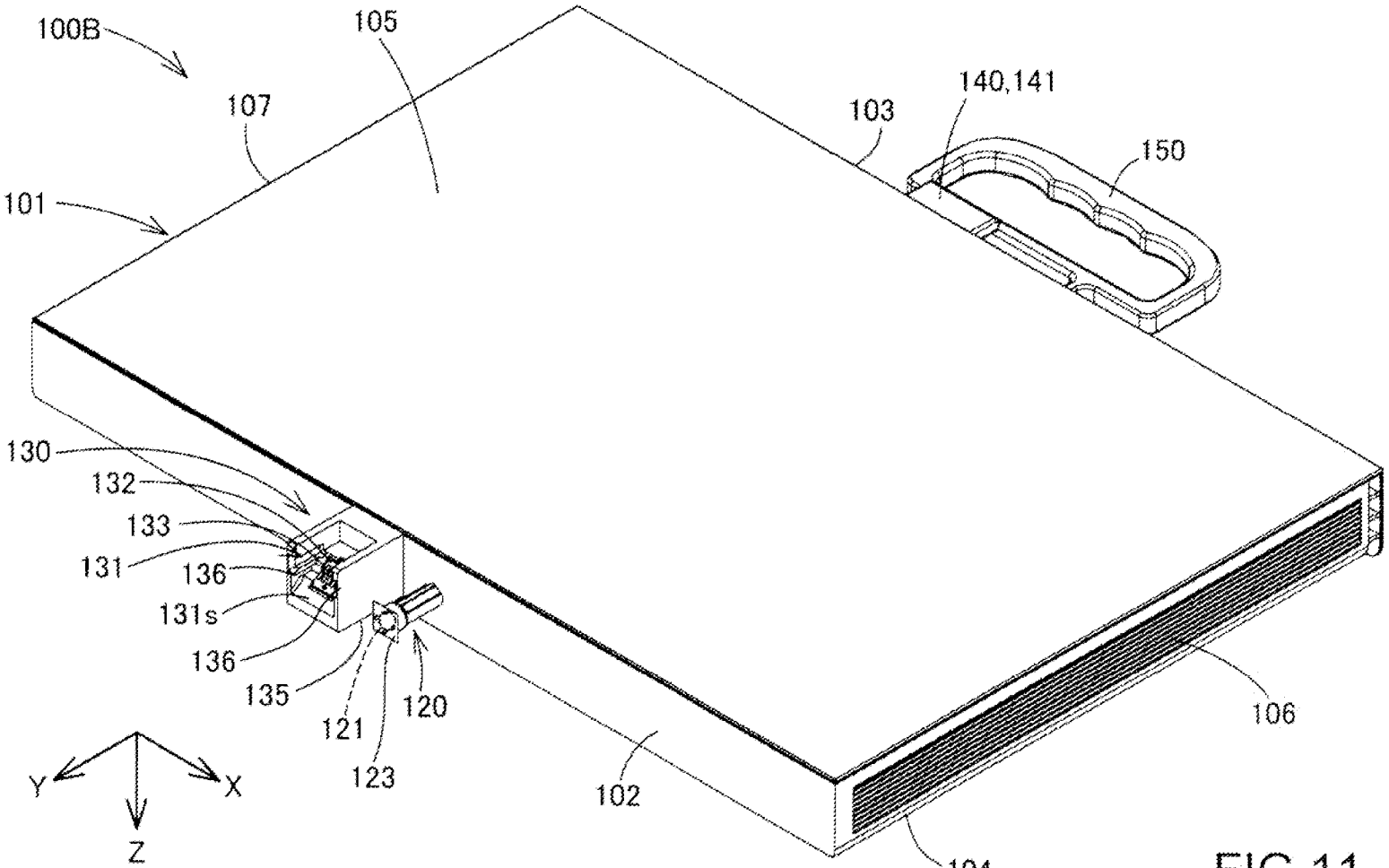
FIG. 11 is a schematic perspective view illustrating a configuration of a cartridge of a second embodiment.
Figure 12:
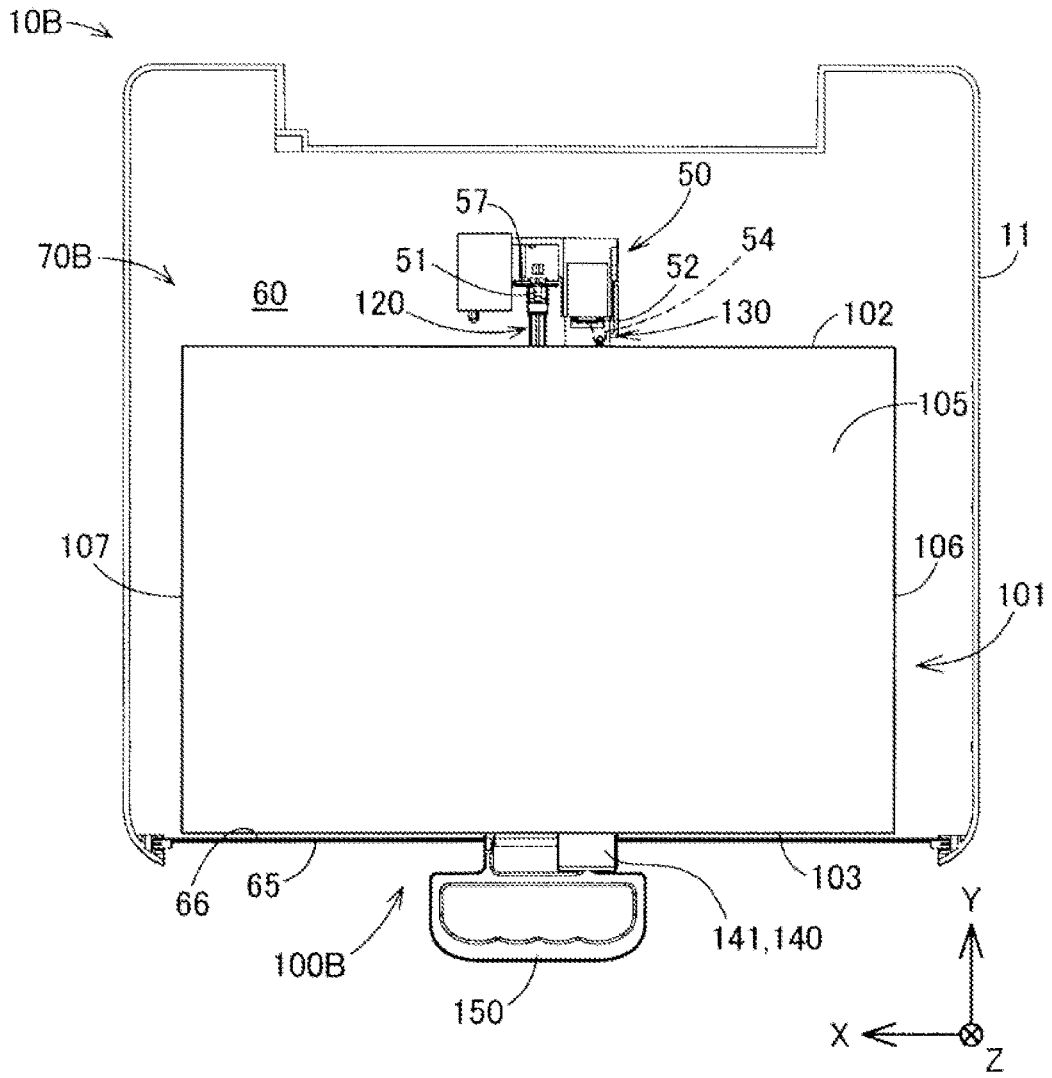
FIG. 12 is a schematic diagram illustrating a state in which a cartridge of the second embodiment is attached.

A configuration of a cartridge 100B in a second embodiment will be described with reference to FIGS. 11 and 12. FIG. 11 is a schematic perspective view illustrating the cartridge 100B of the second embodiment. FIG. 12 is a schematic diagram of a cartridge storage portion 60 to which the cartridge 100B of the second embodiment is attached when viewed in the +Z direction. Note that, in FIG. 12, constituent portions other than a connection receiver 50 that are provided inside the cartridge storage portion 60 are not illustrated for the sake of convenience.

The cartridge 100B (FIG. 11) of the second embodiment is configured almost the same as the cartridge 100 described in the first embodiment excluding the point that the width of a main body 101 in the X direction is larger than that of the main body 101 of the cartridge 100 of the first embodiment. In the cartridge 100B, the width of the main body 101 in the X direction is larger than the width thereof in the Y direction. In the cartridge 100B, the width, in the X direction, of a liquid container 110 (illustration omitted) provided inside the main body 101 is increased in accordance with the main body 101. Accordingly, the cartridge 100B can contain more liquid than the cartridge 100 of the first embodiment.

A printer 10B (FIG. 12) of the second embodiment to which the cartridge 100B is attached is configured almost the same as the printer 10 (FIGS. 1 to 5) described in the first embodiment excluding the point that the printer 10B is an inkjet printer that executes single color printing. One cartridge 100B is attached to the cartridge storage portion 60 in a liquid supply unit 70B included in the printer 10B (FIG. 12). One connection receiver 50 to which the cartridge 100B is to be connected is provided at the approximate center in the X direction in a region of the cartridge storage portion 60 on the +Y direction side.

A liquid outlet 120 and a cartridge-side electrical connector 130 of the cartridge 100B are to be respectively connected to a liquid inlet 51 and a device-side electrical connector 52 of a connection receiver 50, similarly to the first embodiment. Also, movement of the cartridge 100B in the −Y direction after being attached is restricted by a lock mechanism 140 provided in a rear face 103, similarly to the first embodiment. In the second embodiment as well, the cartridge 100B is attached to the printer 10B without receiving a biasing force from a device-side fixing structure 54 and a biasing member 57 of the printer 10B.

According to the cartridge 100B of the second embodiment, the volume of liquid can be increased. Also, the width in the X direction is increased, and as a result, the stability of the arrangement posture of the cartridge 100B in the printer 10B is improved. In addition, the cartridge 100B and the liquid supply unit 70B of the second embodiment can exhibit various effects similarly to the first embodiment.

C. Third Embodiment

Figure 13:
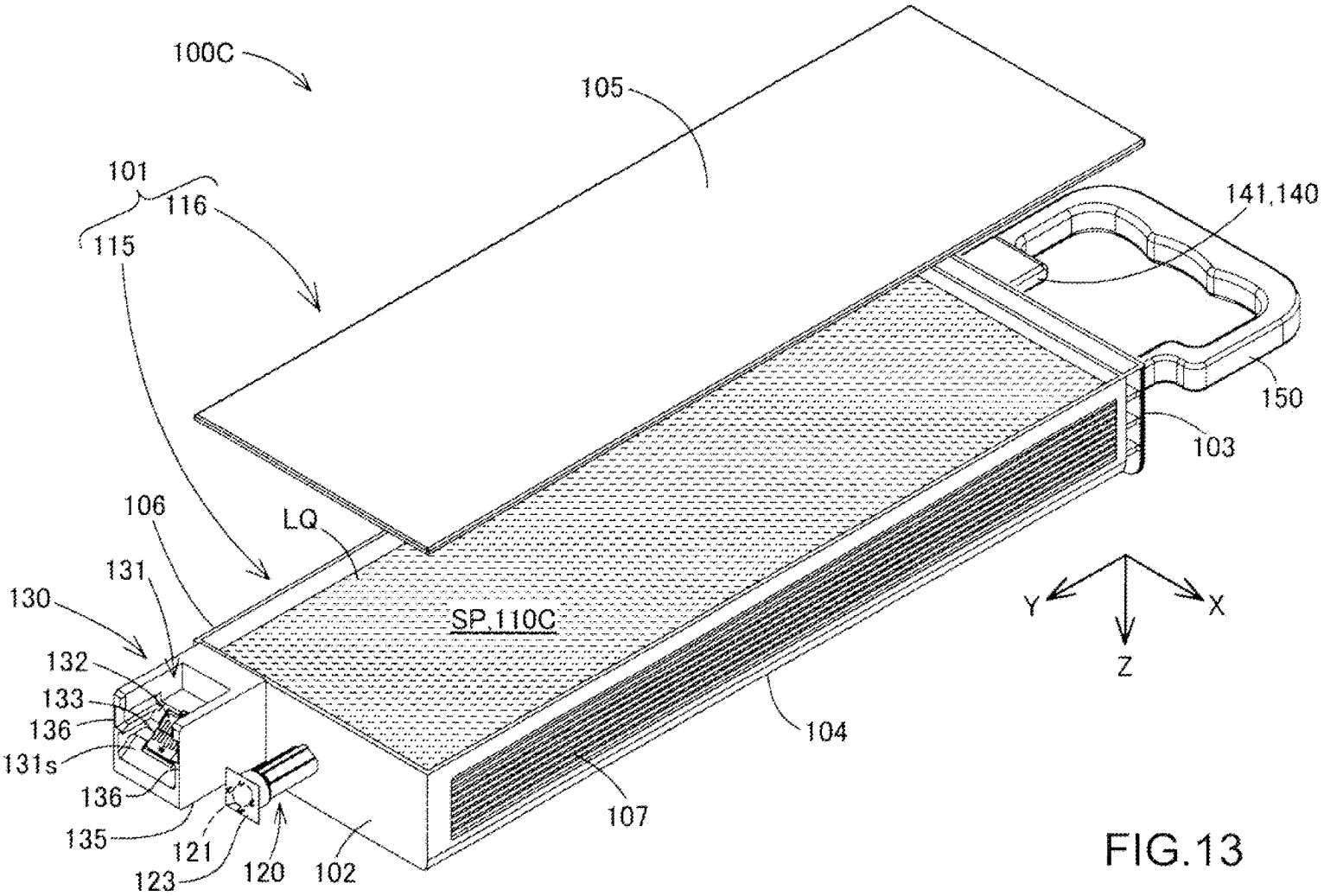
FIG. 13 is a schematic exploded perspective view illustrating a configuration of a cartridge of a third embodiment.

FIG. 13 is a schematic exploded perspective view illustrating a configuration of a first cartridge 100C of a third embodiment. FIG. 13 shows a state in which a cover member 116 is separated from a tray 115 of the first cartridge 100C. The first cartridge 100C (hereinafter, simply referred to as "cartridge 100C") of the third embodiment is configured almost the same as the first cartridge 100*a* described in the first embodiment excluding following points. Note that the changes from the first embodiment described below may be applied to the second cartridge 100*b* of the first embodiment and the cartridge 100B of the second embodiment.

A main body 101 of the cartridge 1000 includes the tray 115 and the cover member 116. The tray 115 is a box-shaped member that opens in the −Z direction, and includes walls that constitute a front face 102, a rear face 103, a lower face 104, and two side faces 106 and 107. The cover member 116 is arranged so as to close the opening of the tray 115, and constitutes an upper face 105 of the main body 101.

A liquid container 110C of the cartridge 100C is not constituted by a flexible bag-shaped member, and is configured such that liquid LQ is directly contained in an inner space SP of the main body 101 that is formed when the opening of the tray 115 is sealed by the cover member 116. That is, the liquid container 110C is configured by the inner space SP.

A seal (illustration omitted) is provided at a boundary between the tray 115 and the cover member 116 in order to prevent leakage of the liquid LQ from the inner space SP. Also, the cover member 116 is provided with an atmospheric air opening for introducing air to the inner space SP in accordance with the consumption of the liquid LQ, and a liquid flow path that suppresses leakage and evaporation of the liquid LQ from the atmospheric opening (illustration omitted). A liquid retaining member that absorbs and retains the liquid LQ therein or a piping member that brings the liquid outlet 120 and the inner space SP into communication may be arranged in the inner space SP.

According to the cartridge 100C of the third embodiment, almost the entirety of the inner space SP of the main body 101, which is a case, can be used as the liquid container 110C, and the amount of liquid LQ that can be contained can be increased relative to the first cartridge 100*a* of the first embodiment. In addition, the cartridge 100C of the third embodiment can exhibit various effects similarly to the first and second embodiments described above.

D. Fourth Embodiment

Figure 14:
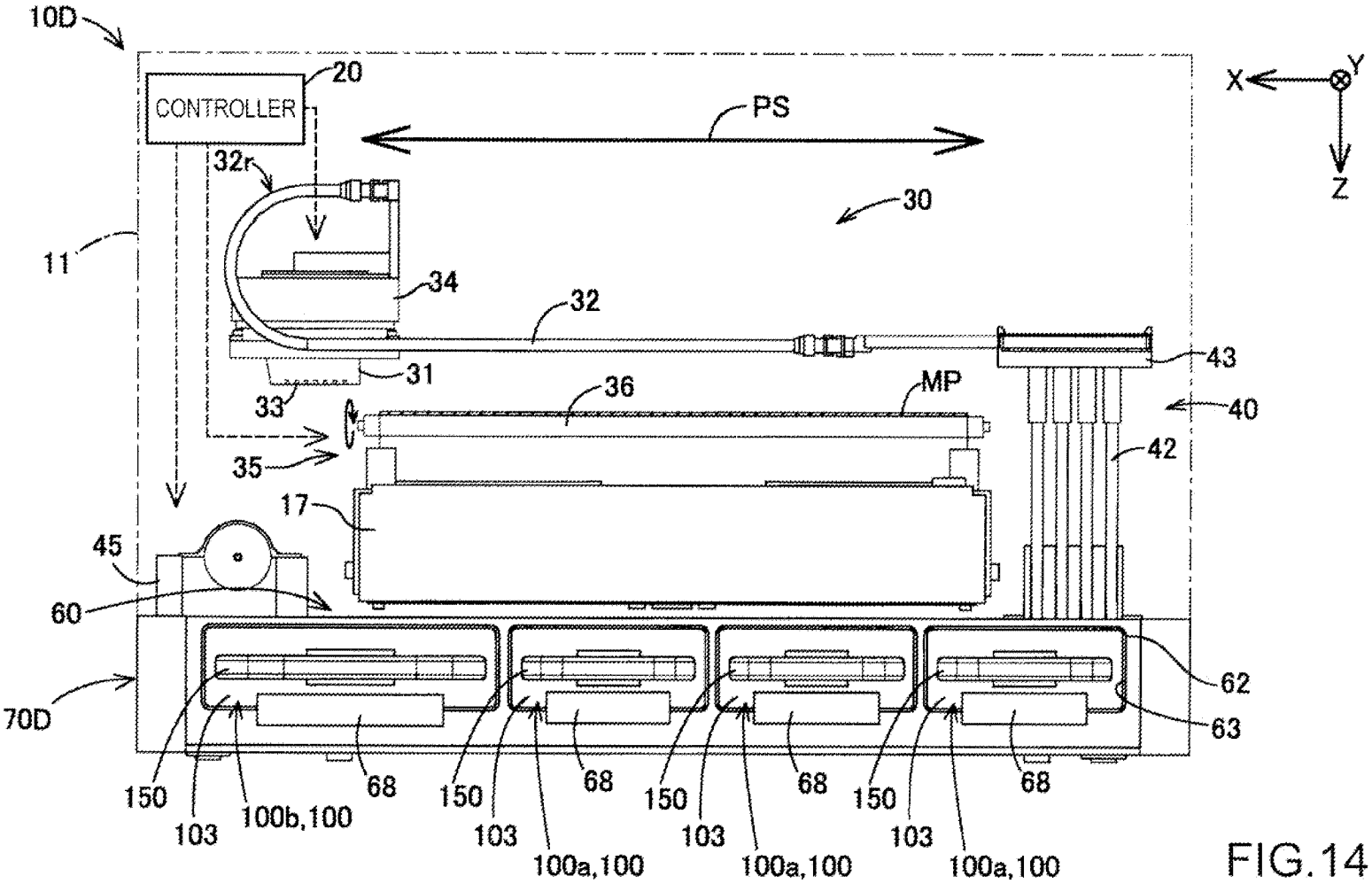
FIG. 14 is a schematic diagram illustrating a liquid supply unit of a fourth embodiment.

FIG. 14 is a schematic diagram illustrating a configuration of a liquid supply unit 70D included in a printer 10D of a fourth embodiment. The printer 10D of the fourth embodiment is configured almost the same as the printer 10 of the first embodiment excluding a point that the liquid supply unit 70D is included in place of the liquid supply unit 70 of the first embodiment. The liquid supply unit 70D of the fourth embodiment is configured almost the same as the liquid supply unit 70 of the first embodiment excluding a point that the lock mechanism 140 of the cartridge 100 is omitted, and an opening member 62 is provided with lock portions 68.

In the liquid supply unit 70D of the fourth embodiment, the lock portions 68 that restrict movement of the respective cartridges 100 in an attached state in the −Y direction are provided at peripheral edges of respective through holes 63 of the opening member 62. Each lock portion 68 is provided on the −Y direction side relative to the rear face 103 of the cartridge 100 in an attached state, comes into contact with the rear face 103 from the −Y direction side, and restricts movement of the cartridge 100. In the fourth embodiment, the lock portions 68 are each constituted by a tape member that is attached across the peripheral edge of the corresponding through hole 63 of the opening member 62 and the rear face 103 of the cartridge 100.

A user attaches the tape member, which is a lock portion 68, after inserting, in the +Y direction, the cartridge 100 into the cartridge storage portion 60 from the through hole 63 of the opening member 62, and as a result, movement of the cartridge 100 in the −Y direction is restricted. The user can take out the cartridge 100 from the cartridge storage portion 60 after removing the lock portion 68.

In the liquid supply unit 70D in the fourth embodiment, the lock portion 68 is provided at a position that can be easily accessed by a user, similarly to the lock mechanism 140.

Therefore, various effects similar to those obtained by the lock mechanism 140 in the first embodiment can be exhibited by the lock portion 68. Also, in the liquid supply unit 70D of the fourth embodiment, the cartridge 100 can be attached (illustration omitted) without receiving a biasing force from a device-side fixing structure 54 and a biasing member 57 of a connection receiver 50, similarly to the liquid supply unit 70 of the first embodiment. Therefore, the force to be applied to the cartridge 100 by a user when the cartridge 100 is attached can be reduced, and the operation to attach the cartridge 100 is made easier. In addition, according to the liquid supply unit 70D of the fourth embodiment, because the cartridge 100 and the cartridge storage portion 60 are configured similarly to the first embodiment, various effects similar to those of the first embodiment can be exhibited.

E. Modifications

Modifications of the above-described embodiments will be described. The modifications to be described later are each considered as an example of a mode for implementing the invention, similarly to the above-described embodiments. Note that, in the following description, when it is not necessary to distinguish the embodiments to be referred to, alphabet letters appended to reference signs of the constituent portions for distinguishing the embodiments will be omitted.

E1. Modification 1:

In each of the above-described embodiments, the +Y direction along which the cartridge 100 is attached to the cartridge storage portion 60 matches the direction oriented from the front toward the rear of the printer 10. With regard to this, the +Y direction along which the cartridge 100 is attached to the cartridge storage portion 60 may not match the direction oriented from the front toward the rear of the printer 10. The direction along which the cartridge 100 is attached to the cartridge storage portion 60 may be a lateral direction of the printer 10, for example. That is, the attachment port for the cartridge 100 may be provided in a side face on a right or left side of the printer 10.

E2. Modification 2:

Four cartridges 100 are attached to the liquid supply unit 70 in the first embodiment described above, and one cartridge 100B is attached to the liquid supply unit 70 in the second embodiment. With respect to this, the number of cartridges 100 attached to the liquid supply unit 70 is not limited to the number in the above-described embodiments. For example, the liquid supply unit 70 may be configured such that only one first cartridge 100*a* or second cartridge 100*b* of the first embodiment can be attached, or two or more of each of the first cartridges 100*a* and second cartridges 100*b* may be attached. Also, in the first embodiment described above, two types of cartridges 100*a* and 100*b* are attached to the liquid supply unit 70. With regard to this, three or more types of cartridges with different configurations may be attached to the liquid supply unit 70. Also, the liquid supply unit 70B to which the cartridge 100B of the second embodiment is attached may be configured such that a plurality of cartridges 100B are stacked in the Z direction and attached in parallel. In this case, the printer 10B of the second embodiment may be configured as an inkjet printer that executes color printing.

E3. Modification 3:

In each of the above-described embodiments, in the cartridge 100, the main body 101 is configured such that, in an attached state, the front face 102 is located on the −Y direction side relative to the device-side fixing structure 54 and the biasing member 57. Accordingly, the cartridge 100 of each of the above-described embodiments is attached to the printer 10 without receiving a biasing force from the device-side fixing structure 54 and the biasing member 57. With regard to this point, the main body 101 may be configured differently such that the cartridge 100 can be attached to the printer 10 without receiving a biasing force from the device-side fixing structure 54 and the biasing member 57. For example, a recess that constitutes a space for accommodating the device-side fixing structure 54 and the biasing member 57 may be provided in the front face 102 of the main body 101, for example. In this case, the liquid supply port 121 and the cartridge-side electrical connector 130 may not be formed so as to protrude from the front face 102 in the +Y direction. The liquid supply port 121 may have an opening in the front face 102 or at a position deep in the −Y direction relative to the front face 102. Also, the cartridge-side electrical connector 130 may also be provided in the front face 102 or at a position deep in the −Y direction relative to the front face 102.

E4. Modification 4:

In the above-described embodiments, the cartridge-side electrical connector 130 is connected to the device-side electrical connector 52 in a state of receiving a biasing force in the −Y direction and a biasing force in the +Z direction from the device-side electrical connector 52. With regard to this point, the cartridge-side electrical connector 130 may be connected to the device-side electrical connector 52 without receiving a biasing force in the +Z direction from the device-side electrical connector 52. In this case, the circuit board 132 of the cartridge-side electrical connector 130 is placed at an angle such that the normal vector of the surface is approximately parallel to the Y direction.

E5. Modification 5:

In the first, second, and third embodiments, the lock mechanism 140 includes the operation portion 141, the engagement portion 142, and the connector 143, and is constituted by a member that slides in the Z direction. With regard to this, the lock mechanism 140 may be realized with another configuration. The lock mechanism 140 may be constituted by a fastener that pivots along the surface of the rear face 103 on the rear face 103 and engages with a wall of the printer 10, for example. Also, the lock mechanism 140 may be constituted by an extension that extends out from the rear face 103 in the Z direction or the X direction, and comes into contact with the periphery of the through hole 63 of the opening member 62 from the −Y direction side so as to attach thereto.

E6. Modification 6:

In the fourth embodiment described above, the lock portion 68 is constituted by a tape member that is to be attached to the rear face 103 of the cartridge 100 and the opening member 62. With respect to this, the lock portion 68 may be realized with another configuration. The lock portion 68 may be constituted by a member that is arranged between the rear face 103 of the cartridge 100 and the opening member 62, and comes into contact with the rear face 103 of the cartridge 100 so as to restrict the rear face 103 of the cartridge 100 from protruding in the −Y direction from the through hole 63 of the opening member 62, for example. The member may be constituted by a hard member with a shape such as a plate or rectangle, or constituted by a soft member that deforms such as a viscous member or a fiber member. Also, the lock portion 68 may be provided in the opening member 62 in a configuration that enables switching between a locked state and a released state by performing a sliding operation similarly to the lock mechanism 140 described in the first embodiment and the like. In addition, the lock portion 68 may be constituted by a cover member that closes the through hole 63 of the opening member 62.

E7. Modification 7:

In the above-described embodiments, the gripper 150 is constituted by a frame member with a substantially rectangular shape. With respect to this, the gripper 150 may be configured in another way. The gripper 150 may be constituted by a string member. Also, the gripper 150 may be constituted by a protrusion that protrudes in the −Y direction, or may be configured as a recess to which a user can hook his/her finger. The gripper 150 may be omitted in the above-described embodiments.

E8. Modification 8:

In the liquid supply unit 70 in each of the above-described embodiments, a configuration may be adopted in which the liquid container 110 of each of the attached cartridges 100 is refilled with a liquid from the outside of the cartridge storage portion 60 via a piping member such as a tube.

E9. Modification 9:

The connection receiver 50 to which the cartridge 100 is connected is not limited to the configuration described in the above-described embodiments. The connection receiver 50 may be configured as a single component, or configured such that the liquid inlet 51 and the device-side electrical connector 52 are separately arranged independently as different members.

The invention is not limited to the above embodiments, examples, and modifications, and can be achieved as various configurations without departing from the gist of the invention. For example, the technical features in the embodiments, examples, and modifications that correspond to the technical features in the aspects described in the summary of the invention may be replaced or combined as appropriate in order to solve a part of, or all of the foregoing problems, or to achieve some or all of the above-described effects. The technical features that are not described as essential in the specification, in addition to the technical features that are described as omittable in the specification, may be deleted as appropriate.

What is claimed is:

1. A cartridge, when a Z direction is defined as a direction parallel to a gravity direction, a direction the same as the gravity direction along the Z direction is defined as a +Z direction, a direction opposite to the gravity direction along the Z direction is defined as a −Z direction, a Y direction is defined as a direction orthogonal to the Z direction, one direction along the Y direction is defined as a +Y direction, the other direction along the Y direction is defined as a −Y direction, an X direction is defined as a direction orthogonal to the Z direction and the Y direction, one direction along the X direction is defined as a +X direction, and the other direction along the X direction is defined as a −X direction, the cartridge being inserted, in the +Y direction, to a printer that includes a liquid introduction portion extending in the Y direction and a device-side electrical connector including a terminal portion that is biased in the −Y direction, and being connected to the liquid introduction portion and the device-side electrical connector from the −Y direction side, the cartridge comprising:

a main body that includes, in an attached state in which the cartridge is attached to the printer, a front face that faces in the +Y direction, a rear face that is on a side opposite to the front face in the Y direction, and faces in the −Y direction, a lower face that faces in the +Z direction, an upper face that is on a side opposite to the lower face in the Z direction, and faces in the −Z direction, and two side faces that are on opposite sides in the X direction;

a liquid container that is provided inside the main body, and contains liquid;

a liquid supply port that is provided in the front face, and is connected, in the attached state, to the liquid introduction portion so as to supply the liquid contained in the liquid container;

a cartridge-side electrical connector that is provided in the front face, and is connected, in the attached state, to the device-side electrical connector while receiving a biasing force in the −Y direction from the terminal portion; and a lock mechanism that is provided in the rear face, and restricts movement of the cartridge in the attached state in the −Y direction relative to the printer.

2. The cartridge according to claim 1, wherein the printer includes a device-side fixing structure that fixes a fixing target that is inserted to a cartridge storage portion for storing the cartridge, from the outside of the printer by applying a biasing force in the −Z direction, and a biasing member that applies a biasing force in the −Y direction to the fixing target, and the cartridge is configured to be attached to the printer without the main body receiving a biasing force from each of the device-side fixing structure and the biasing member.

3. The cartridge according to claim 2, wherein the main body is configured such that, in the attached state, the front face is located on the −Y direction side relative to the device-side fixing structure and the biasing member.

4. The cartridge according to claim 1, wherein the liquid supply port and the cartridge-side electrical connector are provided so as to protrude from the front face in the +Y direction in the attached state.

5. The cartridge according to claim 1, wherein the cartridge-side electrical connector is brought into contact with the terminal portion of the device-side electrical connector from the −Y direction side and the +Z direction side, and receives a biasing force in the +Z direction in addition to a biasing force in the −Y direction from the terminal portion, in the attached state.

6. The cartridge according to claim 1, wherein the rear face is provided with a gripper to be held by a user.

7. The cartridge according to claim 1, wherein the liquid container is constituted by a flexible bag-like member that is accommodated in the main body.

8. The cartridge according to claim 1, wherein the liquid container is configured by an inner space of a case that constitutes the main body.

* * * * *